US008616359B2

(12) United States Patent
Bochonok et al.

(10) Patent No.: US 8,616,359 B2
(45) Date of Patent: *Dec. 31, 2013

(54) SLAT FOR ENHANCING COIN DISTRIBUTION IN COIN BIN AND SECURITY GRATE INCORPORATING SAME

(75) Inventors: Steve Bochonok, Wauconda, IL (US); Mark C. Munro, Barrington, IL (US); John R. Blake, St. Charles, IL (US)

(73) Assignee: Cummins-Allison Corp., Mt. Prospect, IL (US)

( * ) Notice: Subject to any disclaimer, the term of this patent is extended or adjusted under 35 U.S.C. 154(b) by 2042 days.

This patent is subject to a terminal disclaimer.

(21) Appl. No.: 11/267,609

(22) Filed: Nov. 4, 2005 (Under 37 CFR 1.47)

(65) Prior Publication Data

US 2006/0196754 A1 Sep. 7, 2006

Related U.S. Application Data

(62) Division of application No. 10/966,857, filed on Oct. 14, 2004, now Pat. No. 7,658,270.

(60) Provisional application No. 60/511,039, filed on Oct. 14, 2003.

(51) Int. Cl.
*G07D 7/00* (2006.01)
*G07G 3/00* (2006.01)

(52) U.S. Cl.
USPC ..... 194/202; 194/344; 232/62; 232/63

(58) Field of Classification Search
USPC ..... 194/202, 203, 344, 349; 232/12, 14–16, 232/44, 55–63, 5–7, 4 R, 26; 446/8, 10, 118, 446/168–170, 173; 193/DIG. 1; 109/15; 453/63
See application file for complete search history.

(56) References Cited

U.S. PATENT DOCUMENTS

| | | | | | |
|---|---|---|---|---|---|
| 1,268,723 | A * | 6/1918 | Johnson | 232/8 |
| 1,946,736 | A * | 2/1934 | Frey | 273/139 |
| 3,375,912 | A * | 4/1968 | Weitzman | 194/346 |
| 3,403,459 | A * | 10/1968 | Divilbiss | 434/118 |
| 3,685,202 | A * | 8/1972 | Morrison | 446/173 |
| 4,005,662 | A * | 2/1977 | Kohn et al. | 109/16 |
| 4,170,947 | A * | 10/1979 | Morgan | 109/16 |
| 4,230,213 | A * | 10/1980 | Spring | 194/348 |
| 4,756,406 | A * | 7/1988 | Grounds | 206/8 |
| 5,080,251 | A * | 1/1992 | Noack | 206/366 |
| 5,619,821 | A * | 4/1997 | St. George et al. | 49/57 |
| 5,806,652 | A * | 9/1998 | Johnson et al. | 194/347 |
| 5,880,394 | A * | 3/1999 | Kim | 89/36.02 |
| 6,672,195 | B1 * | 1/2004 | Plattner | 89/36.11 |
| 6,811,401 | B1 * | 11/2004 | Cruickshank | 434/189 |
| 2006/0196754 | A1 * | 9/2006 | Bochonok et al. | 194/347 |

* cited by examiner

*Primary Examiner* — Jeffrey Shapiro
(74) *Attorney, Agent, or Firm* — Nixon Peabody LLP

(57) ABSTRACT

According to one embodiment, a security grate for limiting access to a coin bin is disclosed. The security grate comprises a plurality of generally parallel upper slats and a plurality of generally parallel slats disposed below the upper slats. The plurality of first slats receives coins and directs coins moving under the force of gravity in a first direction. The plurality of lower slats receive coins from the upper slats and direct the coins moving under the force of gravity in a second direction.

18 Claims, 19 Drawing Sheets

SLAT FOR ENHANCING COIN DISTRIBUTION IN COIN BIN AND SECURITY GRATE INCORPORATING SAME

This application is a divisional of U.S. patent application Ser. No. 10/966,857, entitled "Coin Bin Having A Security Feature For Limiting Coin Access for Use With A Coin Processing Device," which was filed on Oct. 14, 2004, and is hereby incorporated by reference in its entirety, and this application further claims priority to U.S. Provisional Application Ser. No. 60/511,039, entitled "Coin Bin Having Security Feature For use With a Coin Processing Device," which was filed on Oct. 14, 2003.

TECHNICAL FIELD

Background

Coin processing devices such as coin redemption machines allow users to exchange bulk coins deposits for another form of currency such as currency bills, a receipt that can be applied toward future purchases, or credited to an account. Typically, coin redemption machines are disposed in public locations such as in a retail store or bank. As such, there exists a need to house coins processed by the coin processing machines in a secure environment.

SUMMARY

According to one embodiment, a security grate for limiting access to a coin bin is disclosed. The security grate comprises a plurality of generally parallel upper slats and a plurality of generally parallel slats disposed below the upper slats. The plurality of first slats receives coins and directs coins moving under the force of gravity in a first direction. The plurality of lower slats receive coins from the upper slats and direct the coins moving under the force of gravity in a second direction.

In another aspect, a security grate for a coin bin includes a plurality of slats that define at least one coin path extending between a coin input area to an interior volume of an associated coin bin. The plurality of slats collectively defining a coin path that directs coins input thereto in a first direction along the coin path and in a second direction different than the first direction.

In still another aspect, a security grate for limiting access to a coin bin is provided which includes a plurality of upper slats and a plurality of lower slats disposed substantially below the plurality of upper slats. The plurality of upper slats are disposed to receive coins and direct coins moving thereby in a first direction and the plurality of lower slats are disposed to receive coins from the plurality of upper slats and direct the coins in a second direction.

In yet another aspect, there is provided a security grate for limiting access to a coin bin which includes a first coin path defined by at least a first upper slat and a first lower slat, the first upper slat being disposed in a generally downwardly first direction and the first lower slat being disposed in a generally downwardly second direction. A second coin path is defined by at least a second upper slat and a second lower slat, the second upper slat being disposed in the aforementioned first direction and the second lower slat being disposed in the aforementioned second direction. A third coin path is defined by at least a third upper slat and a third lower slat. The third upper slat is disposed in a generally downwardly third direction and the third lower slat is disposed in a generally downwardly fourth direction. The first upper slat, second upper slat, and third upper slat are disposed to receive coins from a coin source and to facilitate movement of such coins downwardly to the respective first lower slat, second lower slat, and third lower slat. Gaps between adjacent slats are dimensioned slightly larger than the diameter of the largest coin to be passed therethrough.

In another aspect, a coin bin for holding coins from a coin processing device, includes a plurality of walls, a floor, and a movable cover defining an interior volume for holding coins. The coin bin also includes at least one coin input area for receiving coins from the coin processing device, the coin input area protruding from the movable cover, and at least one security grate disposed within the at least one coin input area.

This summary of the present invention is not intended to represent each embodiment, or every aspect, of the present concepts. Additional features and benefits of the present concepts are apparent from the detailed description, figures, and claims set forth below.

Figure 1:
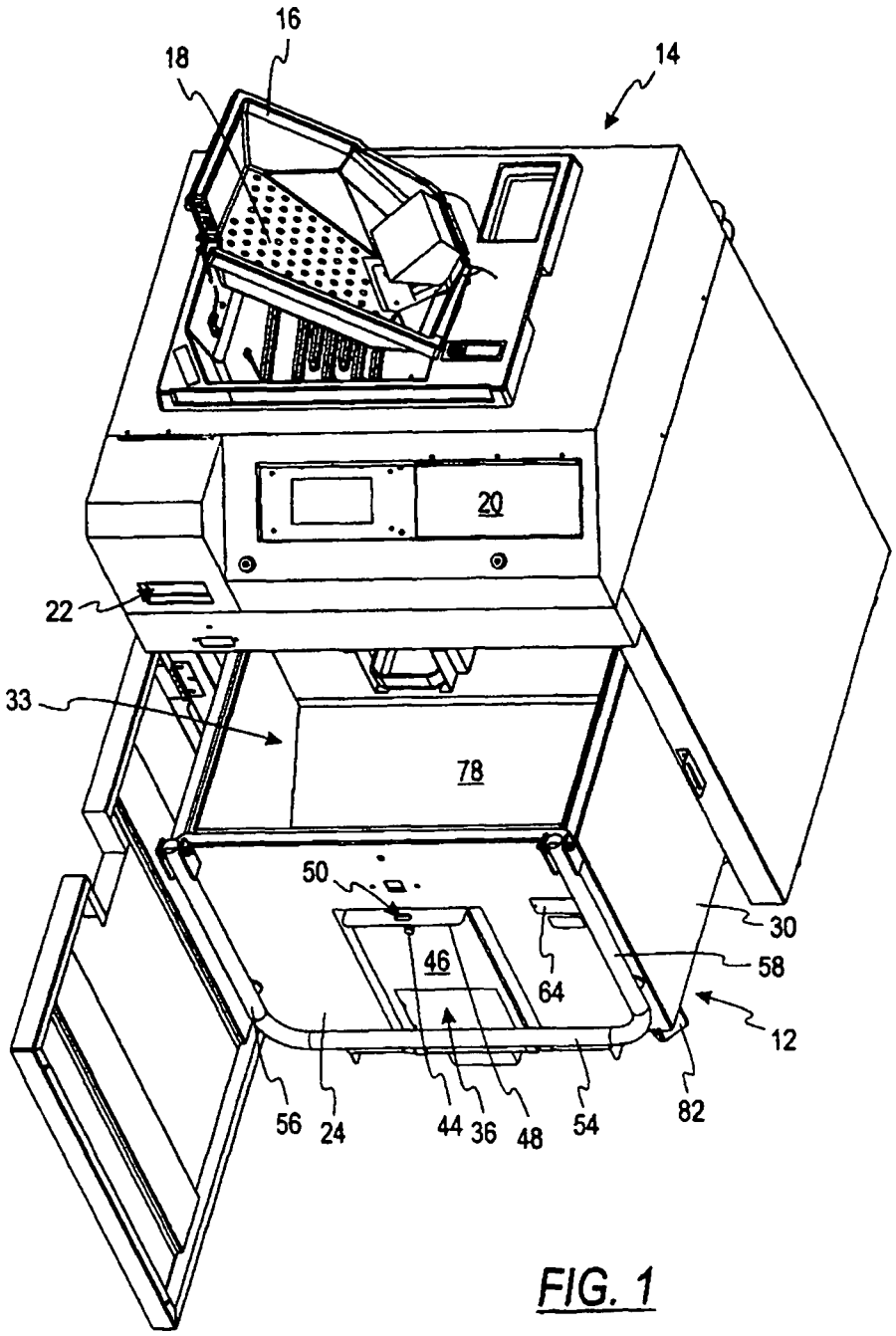
FIG. 1 is a perspective view of a removable coin bin and a coin processing device according to one embodiment of the present concepts.

While the invention is susceptible to various modifications and alternative forms, specific embodiments are shown by way of example in the drawings and are described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE ILLUSTRATED EMBODIMENTS

Figure 2:
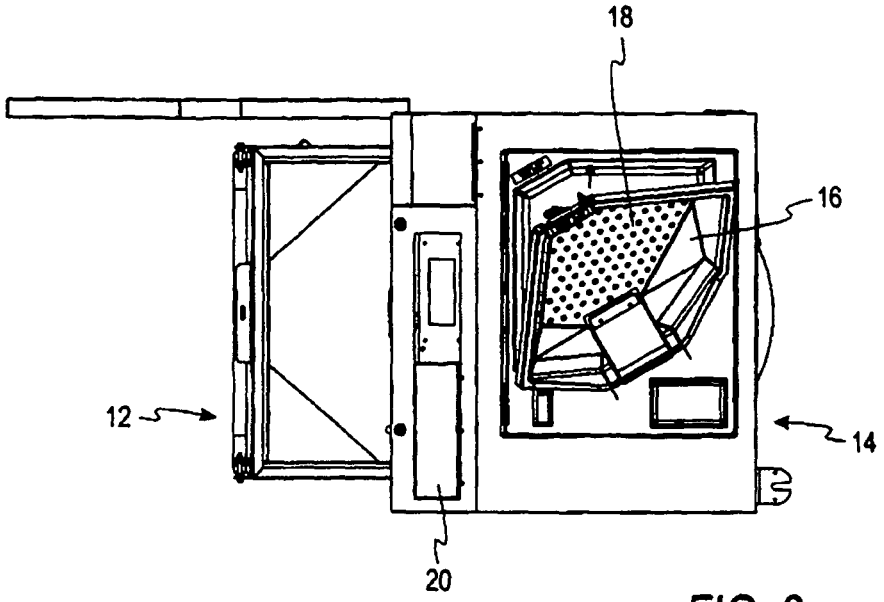
FIG. 2 is a top view of the coin bin and the coin processing device of FIG. 1*a*.
Figure 3:
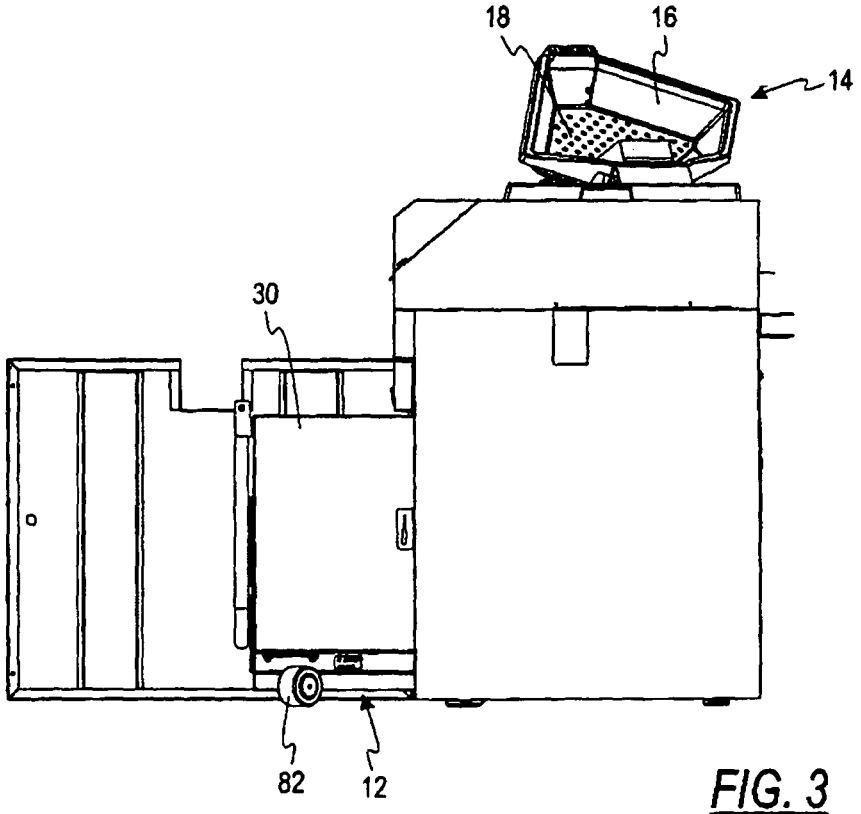
FIG. 3 is a side of the coin bin and the coin processing device of FIG. 1*a;*

Referring now to the drawings, and initially to FIGS. 1-3, one embodiment of a removable coin bin 12 is shown for use with a coin processing device 14, which may comprise a coin processing device for use with a coin redemption machine, automatic teller machine (ATM), coin counter, coin sorter, funds processing machine, vending machine, toll-booth machine, or a gaming machine.

The coin processing device 14 includes a coin input tray 16 for receiving coins from a user of the device 14. The coin input tray 16 includes a perforated bottom 18 for sifting out debris included with input coins. Once coins are received in the input tay 16, the user upwardly pivots (as shown in FIG. 1) input tray 16 causing coins to be directed under the force of gravity into the coin processing device. A coin tray similar to that described that may be used in connection with the coin processing device 14 is described in U.S. Pat. No. 4,964,495, which is incorporated herein by reference in its entirety.

A user interface 20 is disposed on the front of the coin processing device 14 for receiving user inputs and for displaying information to the user. According to one embodiment, the user interface 20 may comprise a touch-screen-type user interface. In other embodiments, the user interface may comprise a separate display and keypad.

The coin processing device 14 further includes a media slot 22 into which the user may insert an account card (e.g., a bank card such as an ATM card, an identification card including the type distributed by grocery stores, a smartcard, etc.). The media slot 22 is coupled to a media reader device or a media reader/writer device in the coin processing device 14 that is capable of reading from or writing to one or more types of media including ATM cards, credit card, smartcards, or other types of media cards. This media may include various types of memory storage technology such as magnetic storage, solid state memory devices, and optical devices. The user interface 20 typically provides the user with a menu of options which prompts the user to carry out a series of actions for identifying the user by displaying certain commands and requesting that the user input information (e.g., a user PIN, account number, etc.).

In general, when the coin processing device is used in a coin redemption application, the coin processing device 14 receives from a user as described, and after these deposited coins have been processed (e.g., authenticated, counted, sorted, or otherwise processed), the coin processing device 14 outputs a receipt to the user indicative of the dollar amount of the deposited coins. The user can redeem the receipt for funds from an attendant of the coin machine 14. An attendant may include a store employee such as a cashier at a grocery store or a teller at a bank. Alternatively, the user can redeem the receipt for credit towards purchases at the store where the machine is located.

Figure 4:
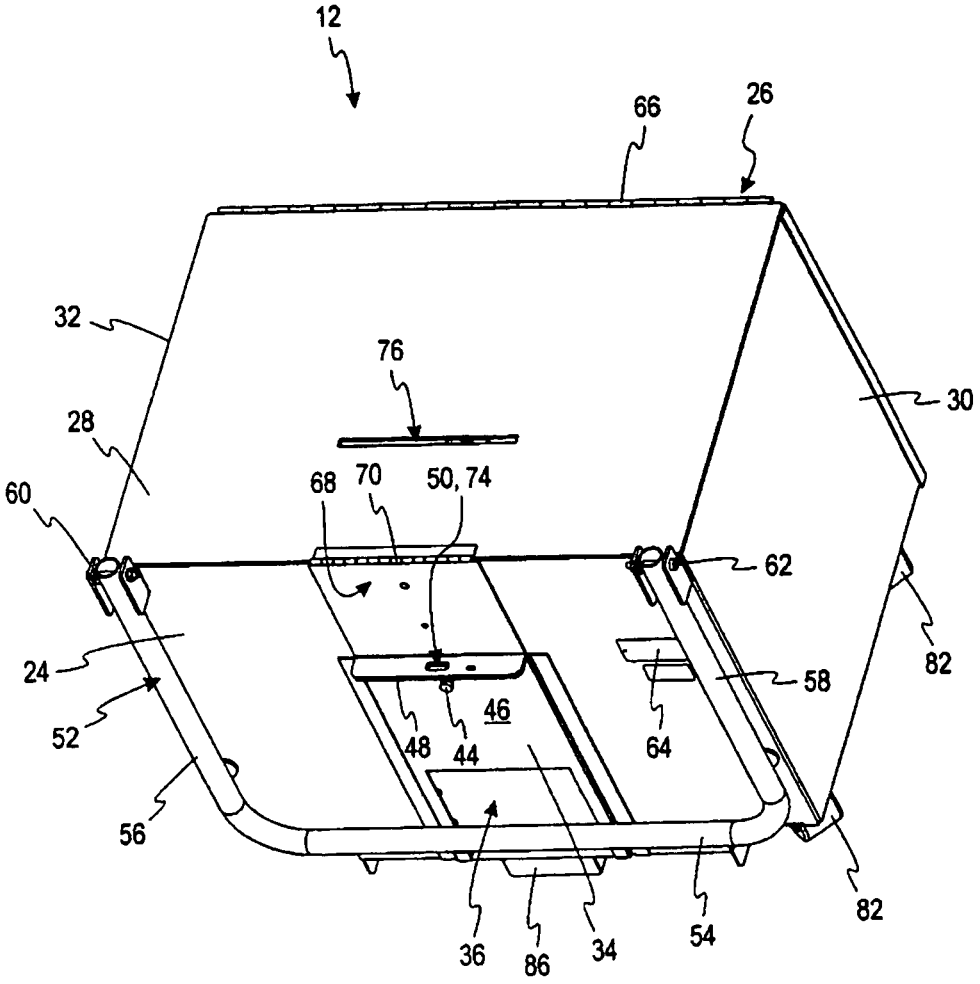
FIG. 4 is a perspective view of the coin bin of FIG. 1*a*.
Figure 5:
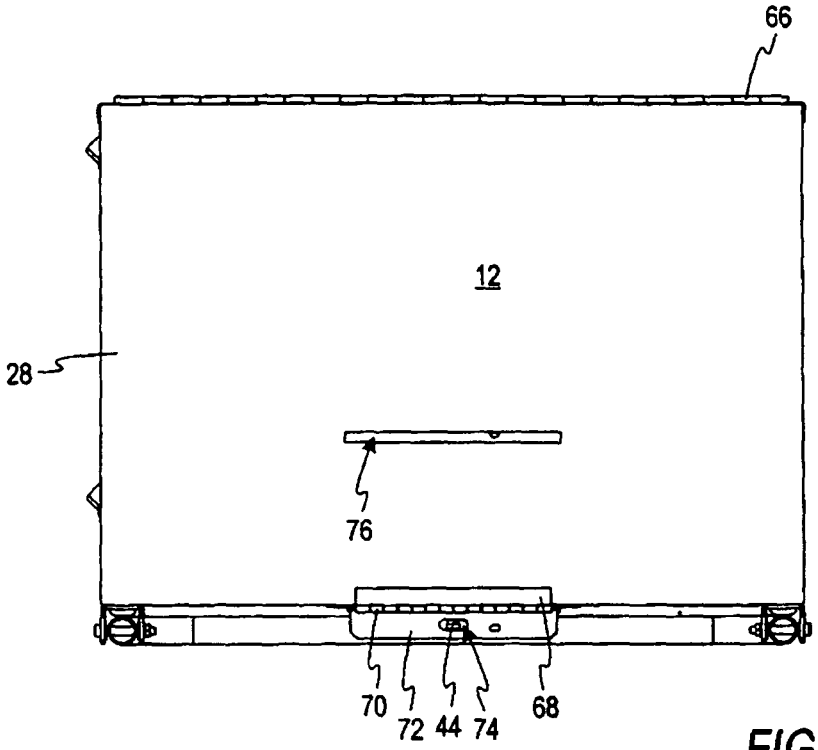
FIG. 5 is a top view of the coin bin of FIG. 2*b*.
Figure 6:
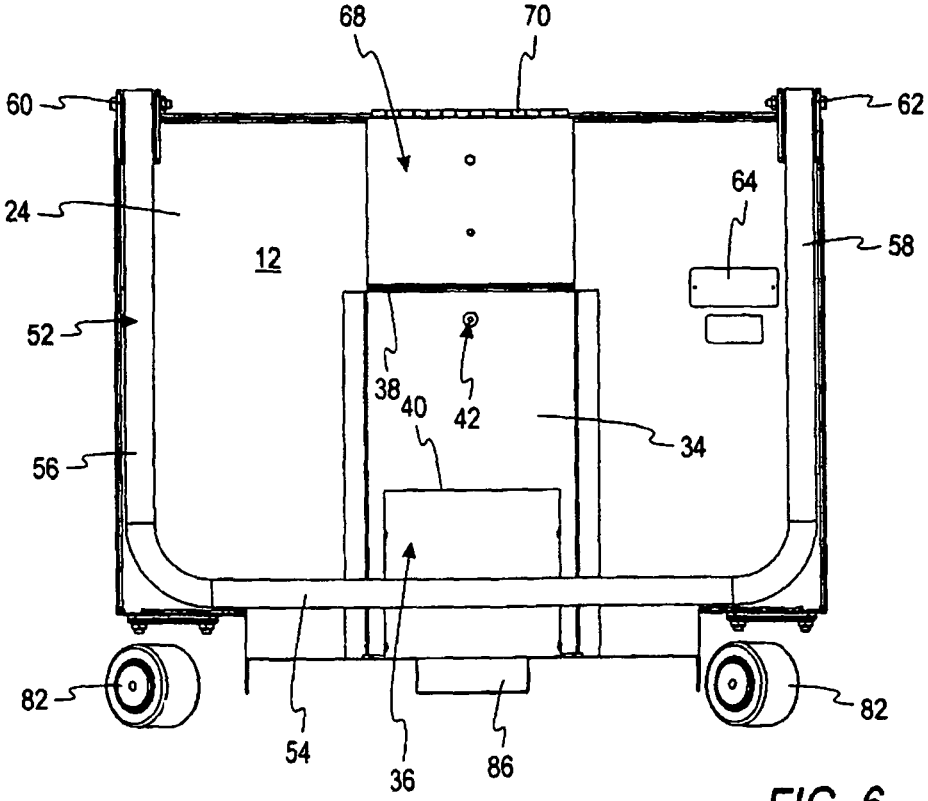
FIG. 6 is a front view the coin bin of FIG. 2*b*.
Figure 7:
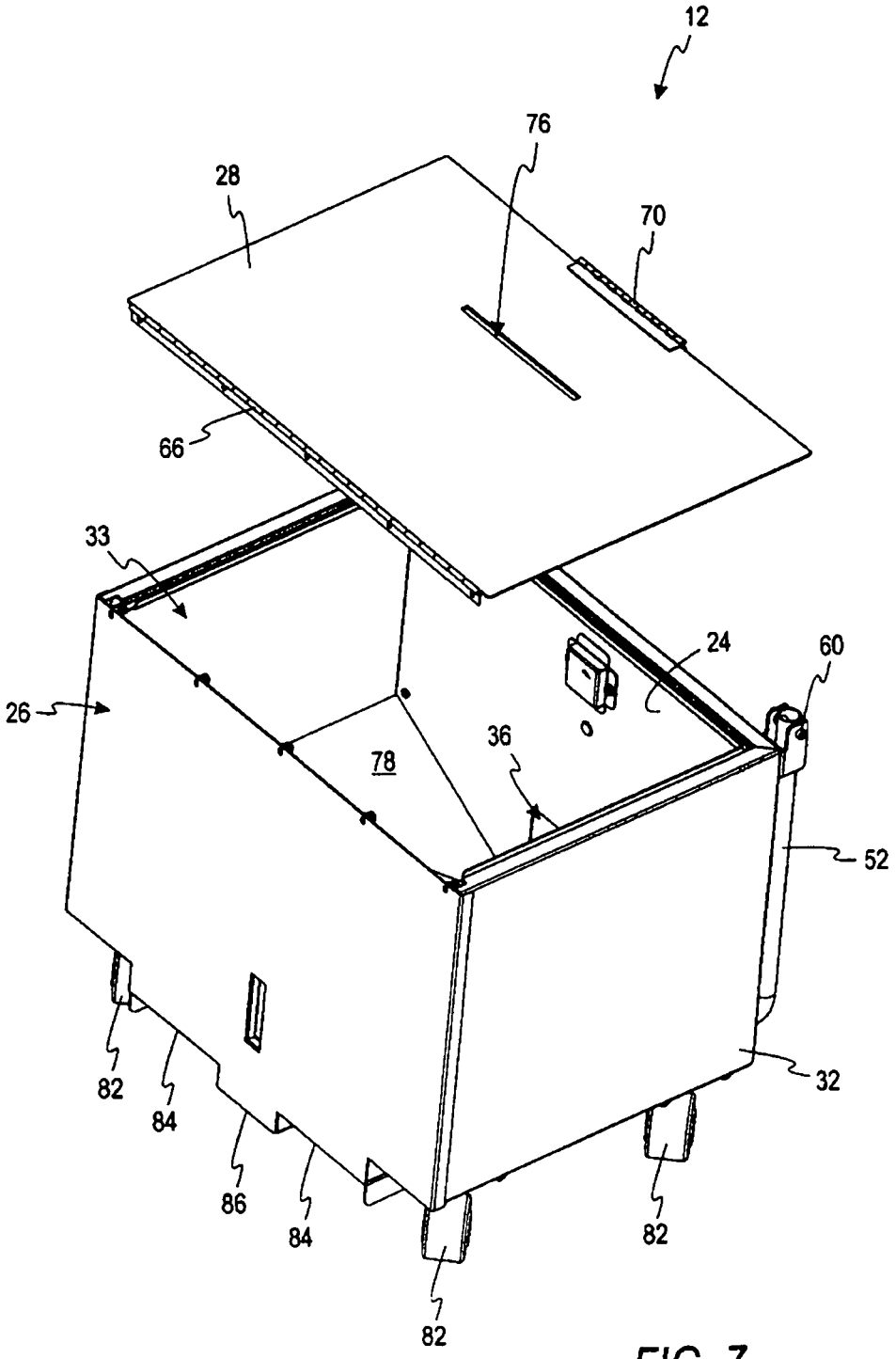
FIG. 7 is an exploded-perspective view of the coin bin of FIG. 1*a*.

Referring also to FIGS. 4-6, one embodiment of a coin bin 12 for use with the coin processing device 14 will be described in detail. Generally, the coin bin 12 receives and hold coins processed by the coin processing device 14. In the illustrated embodiment, the bin 12 is generally rectangular-shaped having a front plate 24, a back plate 26, and a cover plate 28 that is connected to the back plate 26. A first side plate 30 and a second side plate 32 are rigidly connected to the front plate 24 and the back plate 26, forming the basic structure of the coin bin 12 and a coin depositing opening 33.

The front plate 24 includes a pocket 34 centrally located between the first side plate 30 and the second side plate 32, and a coin removal opening 36 located below the pocket 34. The pocket 34 is vertically oriented along the front plate 24, with its width being parallel to the cover 28, and it protrudes out of the front plate 24. The pocket 34 has a first open end 38 and a second open end 40, and it includes a pin hole 42 located proximate the first open end 38. The coin removal opening 36 is located next to the second open end 40 and it has a generally rectangular shape with a width smaller than the width of the pocket 34. An adjusting pin 44 is connected to the pocket 34 and can be inserted into the pin hole 42.

A gate 46 is a generally rectangular plate that includes at least one adjusting hole and a gate ridge 48, which has a first locking hole 50 located in a central position. The gate 46 slides through the pocket 34 between an up position and a down position. When in the up position, coins are allowed to move through coin removal opening 36. When the gate is in the down position, the gate 34 prohibits coins from moving through the coin removal opening 36. The gate 34 has a plurality of position setting for when in the up position to allow an attendant to adjust the removal rate of the coins. The pin 44 is used to fix the gate 46 in a particular up-position setting, as desired by the attendant, by protruding through one of the adjusting holes located in the gate 46. To release coins, the attendant pulls the pin 44, raises the gate 46 to the desired setting by lining up one of the adjusting holes, if there are more than one, with the pin hole 42, and then pushing the pin 44 into both the pin hole 42 and the adjusting hole to fix the gate 46 in the up position. Consequently, the coins inside the coin bin 12 are ready for removal. For a higher coin removal rate the pin 44 should be inserted into an adjusting hole that is located further away from the gate ridge 48, while for a lower coin removal rate the pin 44 should be inserted into an adjusting hole that is located closer to the gate ridge 48. To prevent the removal of coins, the attendant pulls the pin 44 and lowers the gate 46 until the coin removal opening 36 is completely covered by the gate 46.

The front plate 24 includes a handle 52 which is C-shaped and is made from a tube, such as a circular pipe. The handle 52 has in general three sections, a middle section 54 and two lateral sections 56, 58, each of the lateral sections being connected to the front plate 24 at a first pivoting point 60 and a second pivoting point 62. The handle 52 has two main positions, a collapsed position, as shown in FIGS. 4-6, and a transporting position (not shown). A purpose of the collapsed position is to make the coin bin 12 more compact, making sure that the handle 52 does not interfere with the coin processing or the coin removal. In the collapsed position, the handle 52 rests against the front plate 24, having the middle section 54 being positioned near the coin removal opening 36. A purpose of the transporting position is to allow the user the flexibility to move the handle 52 to a position that best fits the user's physical anatomy. For example, a taller person may lift the handle 52 higher than a shorter person. In the transporting position the handle 52 is pivoted upwards, by having an user raise the middle section 54 until the user reaches a comfortable position for using the handle 52 to push or pull the coin bin 12.

In other embodiments the front plate 24 also includes identification plates 64 that are located near the second pivoting point 62. The identification plates 64 can be used to identify relevant information regarding the coin bin 12 or the coin processing device 14, such as the coin bin model, the coin machine model, the owner of the coin bin 12, or the owner of the coin processing device 14, or other identification information.

The cover 28 is a lid that pivots on one end to the back plate 26 by using a first hinge 66 that covers nearly the entire width of the cover 28. The first hinge 66 allows the cover 28 to swing between an open position (FIG. 1) and a closed position (FIG. 5). In the closed position the cover 28 substantially covers the coin depositing opening 33, while in the open position the cover 28 at least partially uncovers the coin depositing opening 33. The coins are deposited or placed in the coin bin 12 through the coin depositing opening 33. The width of the cover 28 is the dimension of the cover 28 that is parallel to a line normal to the first and second sides plates 30, 32 that is normal to the plates 30, 32.

The cover 28 includes a locking plate 68 that is connected to the cover 28 with a second hinge 70. Because the locking plate 68 is hinged to the cover 28, it is free to pivot around the second hinge 70 having in general a locked position and an unlocked position. In general, the locking plate 68 is a rectangular plate having a ridge 72 at one end. The ridge 72 has a second locking hole 74 which is centrally located on the ridge 72, and which has the same general size and shape as the first locking hole 50. Similarly, the ridge 72 has the same general size and shape as the gate ridge 48. When the locking plate 68 is in the locked position, the ridge 72 fits generally over the gate ridge 48 having the second locking hole 74 line up with the first locking hole 50 on the gate 46. Consequently, the locking plate 68 and the gate 46 can be locked using a single locking device, such as a padlock. Therefore, the present invention contemplates a single-locking mechanism comprising the locking plate 68, the gate 46, and a single locking device that locks both openings to the coin bin 12.

Additionally, the cover 28 also includes a long slot 76 that is located in a generally central position for holding the locking plate 68 in a fixed position via a detent mechanism. When the cover 28 is in the open position, the long slot 76 can be used to prevent the locking plate 68 from interfering with the deposit of coins, by holding the locking plate 68 in a stationary position that does not interfere with the coin depositing opening 33. For example, the locking plate 68 can be swung upwards in a clockwise motion and laid flat on the cover 28 having the ridge 72 protruding through the long slot 76, wherein the ridge 72 can be temporarily secured in the long slot 76 using a detent mechanism or structure, e.g., a spring-loaded pin. The long slot 76 can also be used for the insertion of miscellaneous items after the coin bin 12 is locked by the user. Very often, for security reasons, the person transporting the coin bin 12 from one place to another cannot unlock it. However, additional items may have to be placed inside the coin bin 12, such as additional coins or verification receipts, after the coin bin 12 is locked. For example, when a person transporting the coin bin 12 delivers the bin 12, a verification receipt describing the status of the coin bin 12 (e.g., where the coin bin 12 was brought from, how much money is supposed to have, the name and signature of the transporting person, etc.) can be inserted through the long slot 76. Also, the long slot 76 can function as a visual check for an attendant to see how many coins are inside the coin bin 12, i.e., whether the coin bin 12 is full or empty.

Referring now to FIGS. 7-10, the coin bin 12 includes, in another embodiment, an interior sloped surface 78. The sloped surface 78 contains a plurality of planes which are arranged in angled positions that allows the coins to flow freely toward the coin removal opening 36 under the force of gravity. In one embodiment, the sloped surface 78 can be achieved by bending a single plate to achieve the desired plurality of planes. In another embodiment, the sloped surface 78 can be achieved by connecting a number of different plates, using commonly known means such as welding, soldering, or fasteners. The sloped surface 78, using the force of gravity, eliminates the necessity for manual intervention during the operation of removing coins. After the user opens the gate 46, the coins fall through the coin removal opening 36 until the coin bin 12 is completely empty or until the user closes the gate 46. In one embodiment the sloped surface 78 contains three planes (FIG. 8): two symmetrical side planes that are located on either side of the coin removal opening 36 and that have a triangular shape, and a larger central plane. One side of each of the side planes is connected to the interior of the front plate 24, while another side is connected to the respective one of the first side plate 30 and the second side plate 32. The remaining side of each of the side planes forms a common side with the central plane. The central plane has a parallelogram shape, which has a large parallel side, a small parallel side, and two equal connecting sides. Each of the connecting sides form a common boundary with one side of the side planes. The small parallel side forms the bottom edge of the coin removal opening 36, while the large parallel side is connected to the back plate 26.

Figure 9:
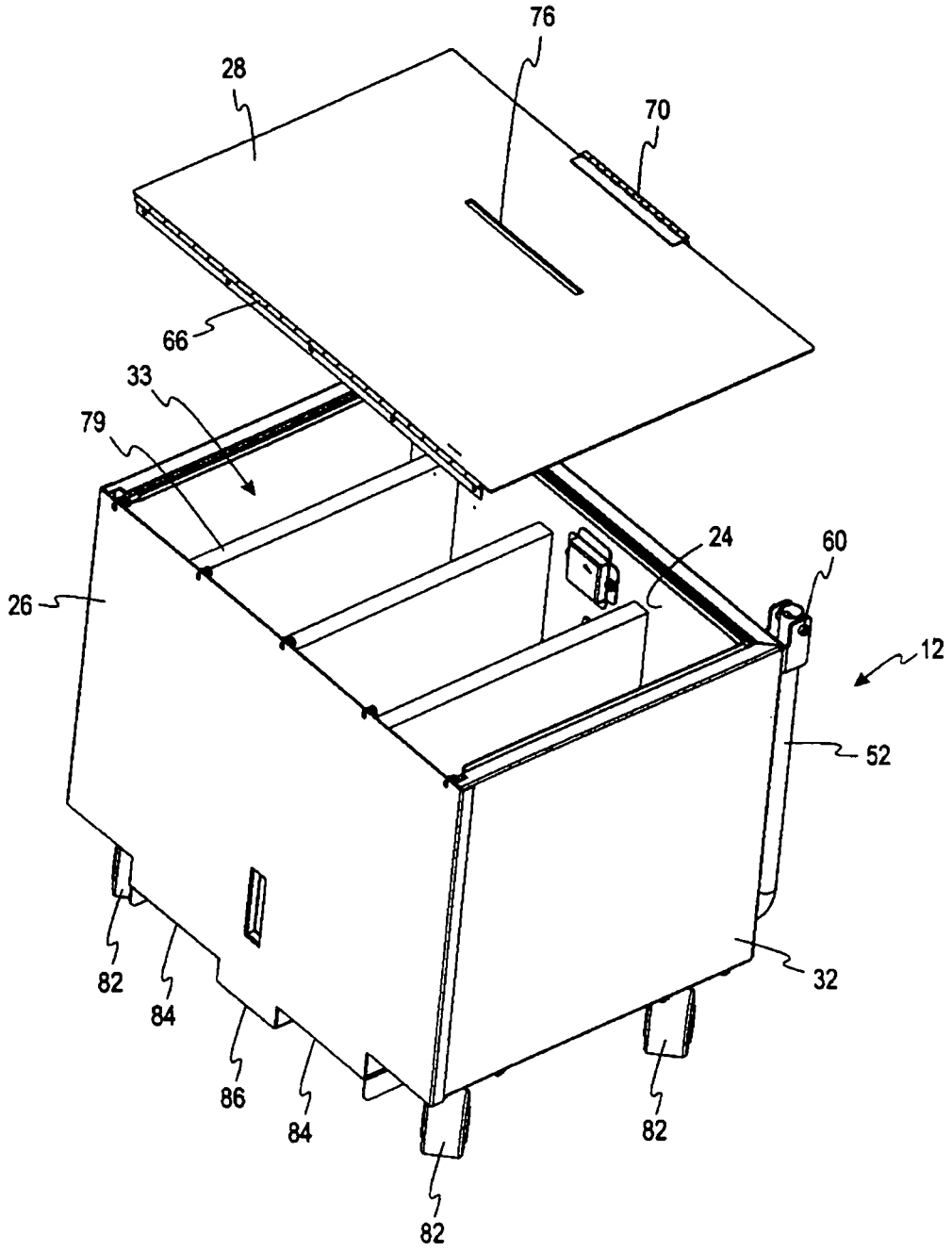
FIG. 9 is an exploded-perspective view of a coin bin according to an alternative embodiment.
Figure 10:
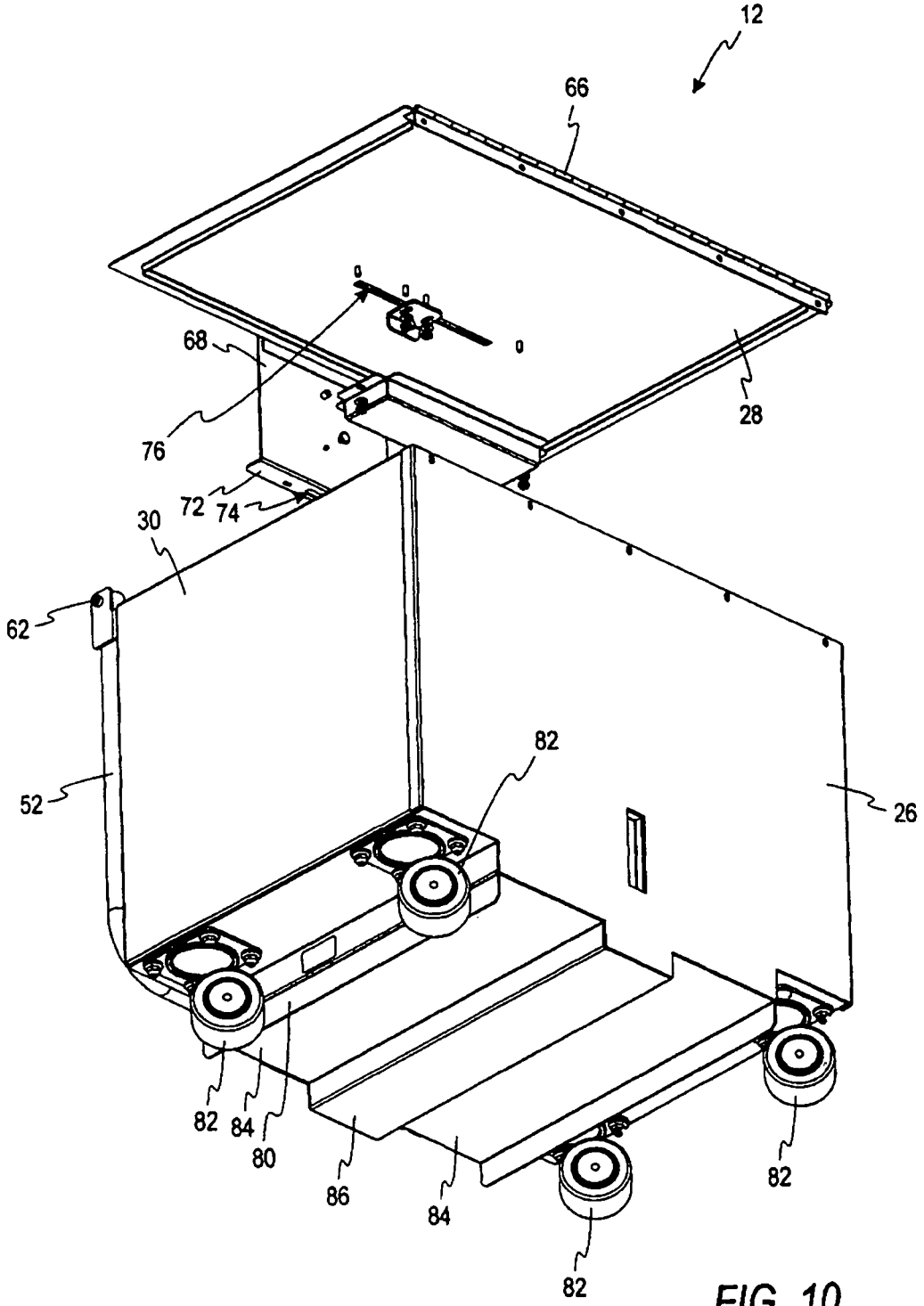
FIG. 10 is a perspective view coin bin of FIG. 1*a*.

In another embodiment the coin bin 12 includes a number of separating plates 79 for dividing the coin bin 12 into a plurality of compartments (FIG. 9). The compartments can be used to sort the coins by denomination, or to contain bags for holding a smaller number of coins. The bags contain in general less coins and are therefore lighter in weight than the coin bin 12, making them easier to transport. The compartments may comprise a plurality of compartment doors for controlling the flow of said coins in each compartment, wherein each one of the compartment doors is individually moveable.

The coin bin 12 also includes a bottom plate 80 which includes a plurality of wheels 82. Four wheels 82 are located in each corner of the bottom plate 80 to facilitate the easy movement of the coin bin 12 from one place to another. The wheels 82 are readily available commercial casters, selected to withstand the several hundred pound weight of the coins and coin bin 12. In other embodiments, the number of wheels varies from two wheels to as many as desired.

In another embodiment, the bottom plate 80 preferably has a number of grooves 84 which are separated by a central bar 86. Each one of the grooves 84 and the central bar 86 has two ends which form a longer dimension, the length, and are oriented such that one end of the length is near the front plate 24 while the other end is near the back plate 26. One of the functions of the grooves 84 is to allow the transportation of the coin bin 12 by using a forklift device, such as a hand or a motorized truck. In other embodiments two more side bars can be located parallel to the central bar 86 such that they restrict the forklift device from moving sideways, towards the wheels 82.

In other embodiments of the present invention, any one or more of the sloped surface 78, the front plate 24, the first side plate 30, the second side plate 32, the back plate 26, the cover 28, and the separating plates can be covered with a laminated material having multiple layers. The laminated material has two outer layers which are made of a metal, and a thin inner layer which is made of a non-metal that holds the outer two layers together. The thin inner layer serves to dampen the vibrations of coins impacting the outer layers. The inner layer converts the vibrational energy into thermal energy. The laminated material comes in a variety of thicknesses, with the smallest one being about 0.04 inch and the largest being about 0.375 inch. Preferably, the laminated material is a stainless steel. Such materials are available through various sources, including Classic Sheet Metal in Schiller Park, Ill. A laminated material similar to the one that was described above is described in greater detail in U.S. Patent Application Publication No. US 2002/0130011 A1, entitled "Coin Processing Machine Having Coin-Impact Surfaces Made From Laminated Metal," which was filed on Mar. 19, 2001 and is incorporated herein by reference in its entirety.

Figure 11:
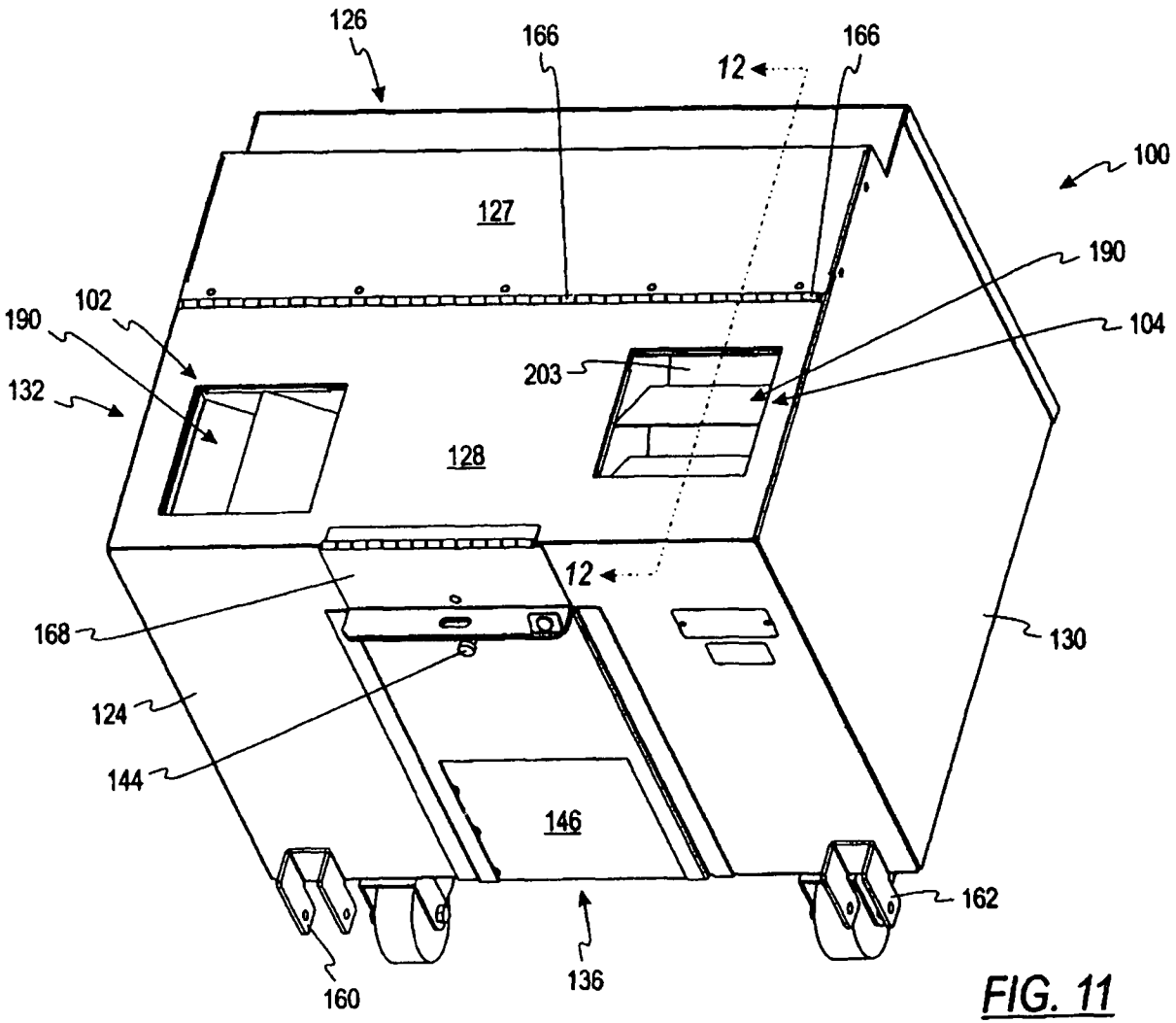
FIG. 11 is a perspective view of a coin bin in accord with the present concepts.

Referring now to FIG. 11, a coin bin 100 is shown according to an alternative embodiment of the present invention. The coin bin 100 includes a first coin input area 102 and a second coin input area 104 for receiving coins processed by the coin processing device 14 (FIG. 1). Generally, as will be described in greater detail, the first and second coin input areas 102, 104 each include a security grate that comprises a plurality of slats that are angled in a manner to limit access to the interior of the coin bin 100. The slats of the security grates are sized and spaced to allow the flow of coins from the coin processing device 14 into the coin bin 100, but to at least inhibit most human hands and arms from accessing coins contained within the coin bin 100. In operation, processed coins output by the coin processing device 14 are directed (e.g., via funnels) to one of the coin input areas 102, 104 where the processed coins flow through the security grates into the coin bin 100.

The coin bin 100 is similar in several respects to the coin bin illustrated in FIGS. 4-8. The coin bin 100 includes four sides 124, 126, 130, and 132. The front side 126 includes a gate 146 that vertically moves from a closed position (FIG. 11) to an open position (not shown) for exposing the coin removal opening 136. The coin bin 100 includes a pin 144 for maintaining the gate 146 in one or more open positions as described above. The coin bin 100 includes one or more sloped interior bottom surfaces 178*a,b,c* (FIG. 12) that directs coins toward the coin removal opening 136. The coin bin includes first and second pivoting brackets 160 and 162 to which a handle 54 (FIG. 4) is pivotally mounted.

The coin bin 100 includes a cover having a stationary portion 127 that does not move and a pivotal lid 128 that is a pivotally attached to the coin bin 100 by a hinge 166. The pivotal lid 128 upwardly pivots to allow access to the coins contained within the coin bin 100. A locking plate 168 is hingedly attached to the front end of the pivotal lid 128. The locking plate 168 is used for locking the pivotal lid 128 and the gate 146 to prevent opening the pivotal lid 128 or the gate 146 as is described above in connection with FIGS. 4-6. The pivotal lid includes two apertures 190 corresponding to the two coin input areas 202, 204 of the coin bin 100.

Figure 12:
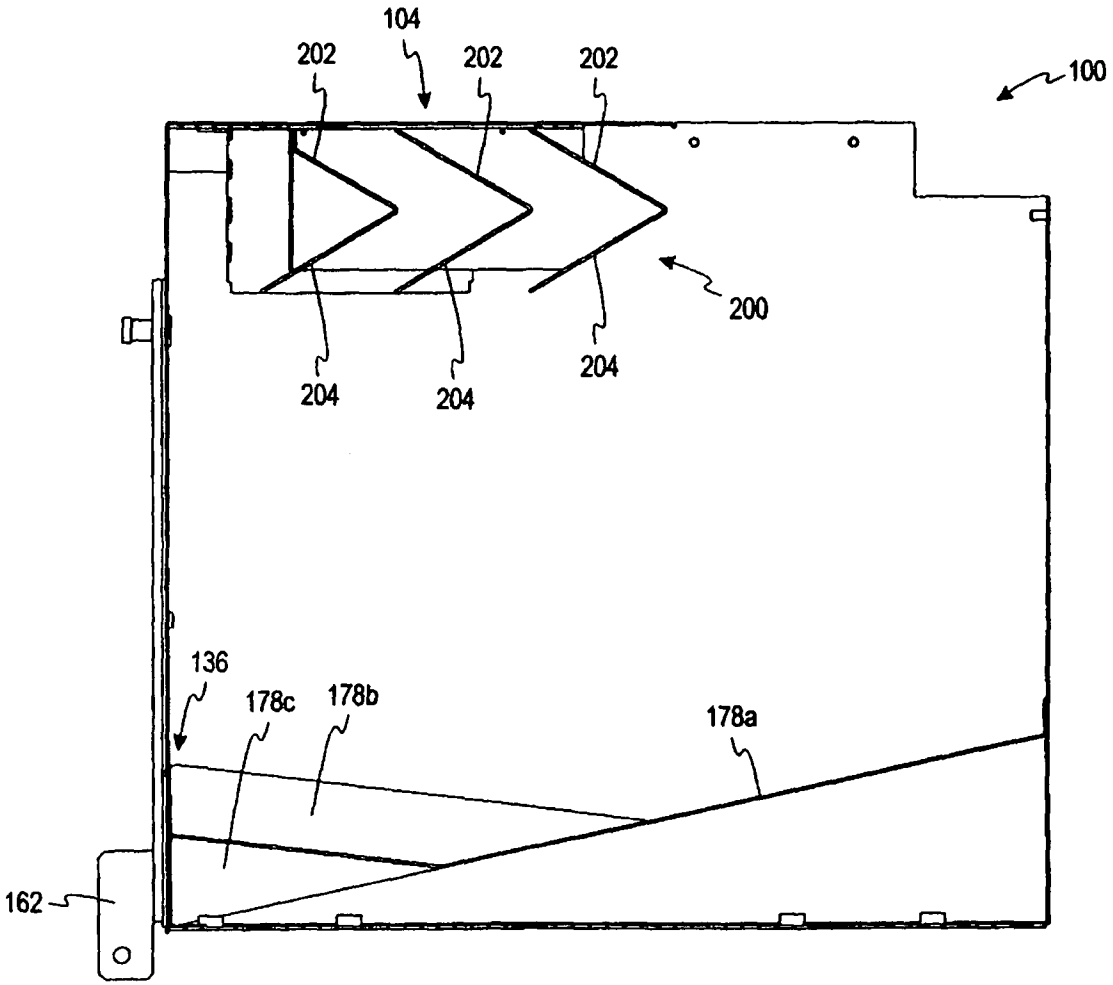
FIG. 12 is a sectional view taken along line 12-12 of FIG. 11.

Referring also to FIG. 12, disposed below each aperture 190 of each coin input area 202, 204 is a security grate 200 that comprises a plurality of upper slats 202 and lower slats 204. The upper slats 202 are generally parallel to the other upper slats 202, and the lower slats 202 are generally parallel to the other lower slats 202. The slats are generally rectangular in shape and disposed such that a wide edge of the slat is generally parallel with the horizontal. Each upper and lower slat 202, 204 is arranged in a generally V-shaped configuration as shown in FIG. 12. The upper and lower slats 202, 204 may be integrally formed such that they are formed from the same piece of material as illustrated, or my comprise separate pieces.

Figure 13:
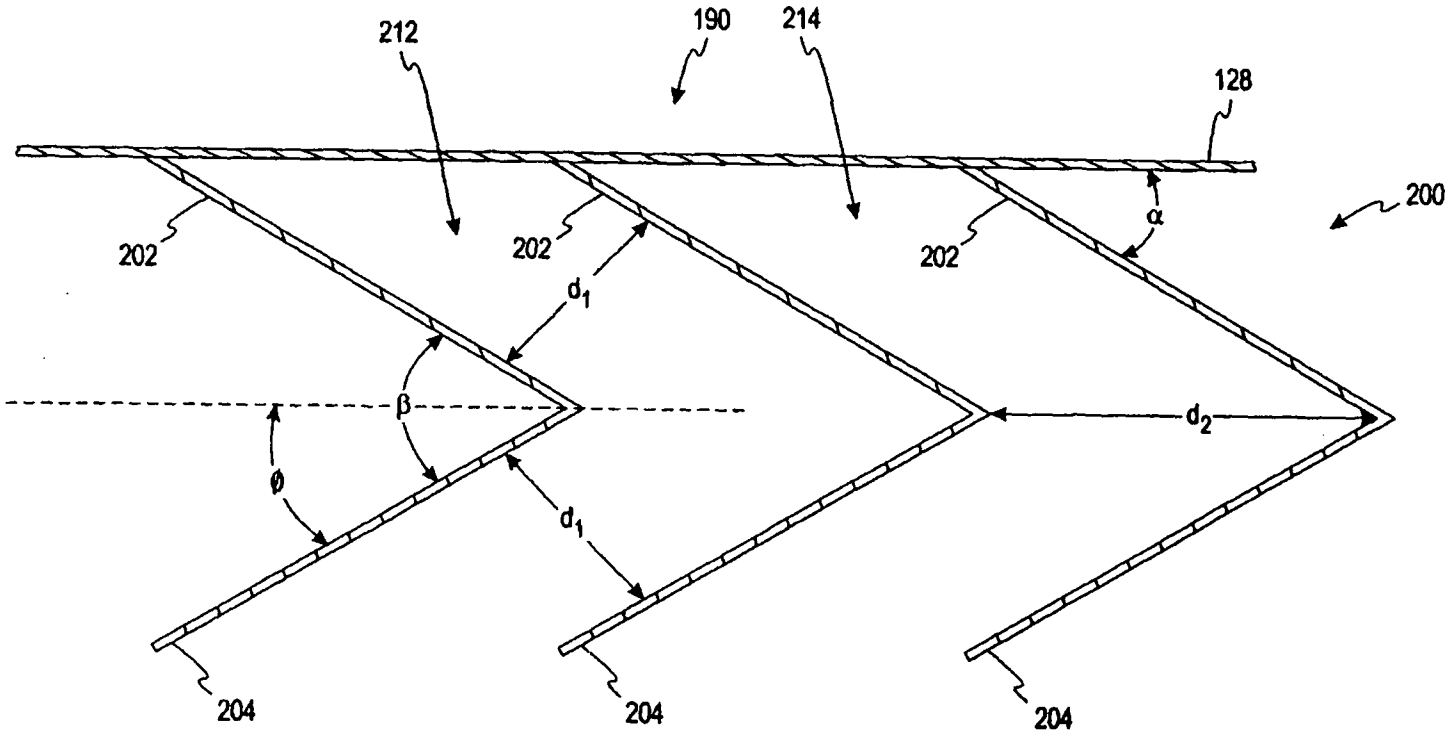
FIG. 13 is a side view of a security grate in accord with the present concepts.

Referring also to FIG. 13, the upper and lower slats 202, 204 of a security grate 200 are shown. During the processing of coins by the coin processing device 10 (FIG. 1), processed coins are output to the coin input areas 102, 104. The three pairs of upper and lower slats 202, 204 form a first coin path 212 and a second coin path 214 between the slats 202, 204 through which processed coins move under the force of gravity. As the coins move through the coins paths 212, 214 of the security grate 200, the coins contact the various surfaces of the slats 202, 204. The upper slats 202 direct the coins in a first direction (down and to the right as viewed in FIGS. 12 and 13) and the lower slats 204 direct the coins in a second direction (down and to the left as viewed in FIGS. 12 and 13) as the coins move along the coin paths 212, 214. While the illustrated security grate 200 includes two coins paths 212, 214, the security grate may have any practical number of coins paths in alternative embodiments of the present invention. Because the slats 202, 204 are subjected to forces applied by the moving coins, the slats 202, 204 are constructed of rigid, durable material such as steel, another rigid metal or alloy, or other rigid material. Additionally, as described later, the ends of the slats 202, 204 may be supported to increase the rigidity of the security grate 200.

The bidirectional coin paths 212, 214 of the security grate 200 effectively prohibit or inhibit a person from accessing the coins within the coin bin 100 through the coin input areas 102, 104 of the storage bin. Put another way, the nonlinear nature of the coin paths 212, 214 prohibit an unscrupulous person from reaching into the coin bin 100. When the gate 144 is locked to the locking plate 168 via a padlock, for example, as is described above, the coin bin 100 provides a secure receptacle for holding coins. Thus, only those authorized to access the coins in the coin bin 100 may access the coins when the gate 144 and locking plate 168 are locked.

The dimensions of the security grate 200 are described according to one embodiment of the present invention. The upper slats 202 are disposed a distance $d_1$ from an adjacent upper slat 202 in a direction normal to an upper slat 202. The lower slats 204 are also disposed an approximately equivalent distance $d_1$ from an adjacent lower slat 204. The distance $d_1$ is slightly larger than the diameter of the largest coin to be processed. When, for example, the coin processing device 10 is placed in a grocery store in the U.S., the largest-diameter coin typically encountered is a U.S. half-dollar, which has a diameter of about 1.205 inch. And, in this application, the distance $d_1$ would be about 1.31 inch. In the horizontal direction, the pairs of slats 202, 204 are disposed a distance $d_2$ from the adjacent pair of slats 202, 204. The distance $d_2$ is about 2.62 inches according to one embodiment of the present invention. Each of the upper slats 202 are disposed at an angle $\alpha$ relative to the pivotal lid 128 of about 30°. Each of the lower slats 204 are disposed at an angle $\beta$, which is about 60°, relative to the respective upper slats. The lower slats 204 are downwardly angled from the horizontal at an angle $\phi$ of about 30°. The upper and lower slats 202, 204 are similarly dimension according to one embodiment of the present invention and have a width of about 5 inches and a length of about 3 inches.

These dimensions may be varied in other alternative embodiments of the present invention. For example: $d_1$ may range between about 1.25 inch and about 1.30 inch; $d_2$ may range between about 2.50 inch and about 2.76 inch; angle $\alpha$ may range between about 22° and about 90°; angle $\beta$ may range between about 44° and about 180°; angle $\phi$ may range between about 22° and about 90° inch; the width of the upper and lower slats vary may range between about 1.25 inches and about infinite inches; and the length of the upper and lower slats vary may range between about 2.50 inches and about 10 inches according to various alternative embodiments of the present invention. Alternatively, the upper slats 202 may be sized differently than the lower slats 204 of the security grate 200.

Figure 14:
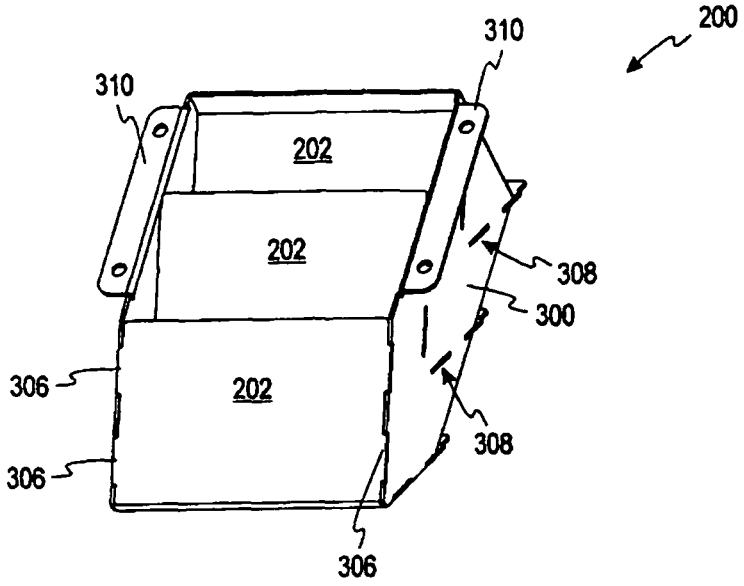
FIG. 14 is a perspective view of a security grate in accord with the present concepts.
Figure 15:
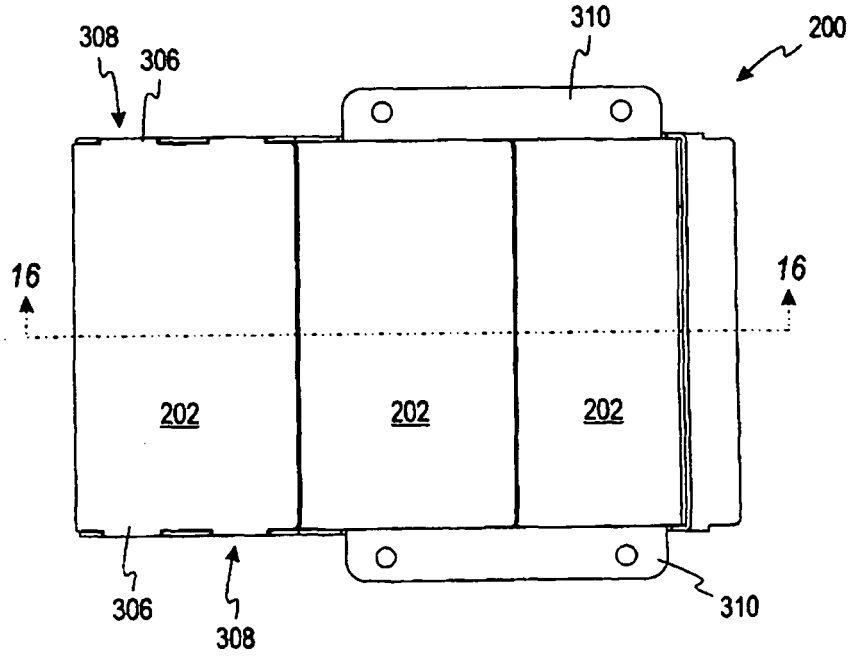
FIG. 15 is a top view of the security grate of FIG. 14.
Figure 16:
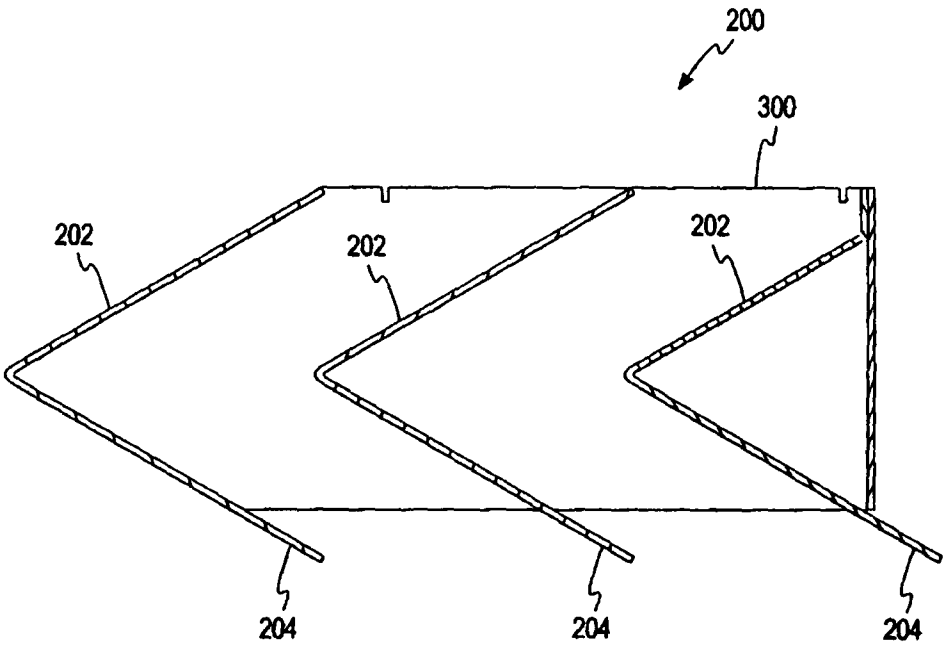
FIG. 16 is a sectional view taken along line 16-16 in FIG. 15.

Referring now to FIGS. 14-16, a bracket 300 for holding the upper and lower slats 202, 204 of the security grate 200 is shown. In the illustrated embodiment, each of pair of upper and lower slats 202, 204 are formed from the same piece of material that is angled in the V-shaped confirmation. Each of the slats 202, 204 include a plurality of outwardly-extending tabs 306 that mate with corresponding apertures 308 in the bracket 300. The tabs 306 and corresponding apertures 308 hold the slats 202, 204 in place at multiple points to maintain the position of the slats 202, 204 as the slats 202, 204 are contacting by the moving coins. The bracket 300 includes a pair of flanges 310 for mounting the bracket—and, thus, the security gate—to the underside of the coin bin's pivotal lid 129. The bracket 300 holds the slats 202, 204 in place and also supports the edges of the slats 202, 204 as coins move across the slats 202, 204.

As is apparent from the foregoing, the security grate 200 provides a physical barrier, or at least a physical deterrent from, for preventing an unauthorized individual from accessing coins contained within the coin bin 100. Further, the security grate 300 also provides a visual barrier, or a visual deterrent, for preventing an unauthorized individual from visually accessing the coins contained within the coin bin. Put another way, due to the slats 202, 204 angling in one direction and then the other, a person cannot view the coins contained within the coin bin. Thus, the security grates 200 provide a psychological barrier to prevent an unauthorized individual person from accessing the coins contained within the coin bin.

Thus far, the security grate has been discussed as a security feature to prevent unauthorized individuals from accessing coins contained within the coin bin. However, in other alternative embodiments of the present invention, other security features may be implemented. For example, a security screen may cover the apertures 190 (FIG. 11) of the coin input areas 102, 104. While a screen may not provide a visual barrier as discussed above, a screen would provide a physical barrier to prevent an unauthorized individual person from accessing the coins contained within the coin bin. In such an embodiment, the screen has openings sized large enough to allow coins to flow through the screens (e.g., openings dimensioned slightly larger than the diameter of the largest coin to be processed), but small enough to prevent a human hand from reaching through a screen opening to access the coins contained within the coin bin. The screen is constructed out of a strong material such as metal, for example, and sized such that is difficult to cut or otherwise damage the screen in an unauthorized attempt to access the coins contained within the coin bin.

Many other types of security features may also be implemented in alternative embodiments of the present invention.

Figure 17:
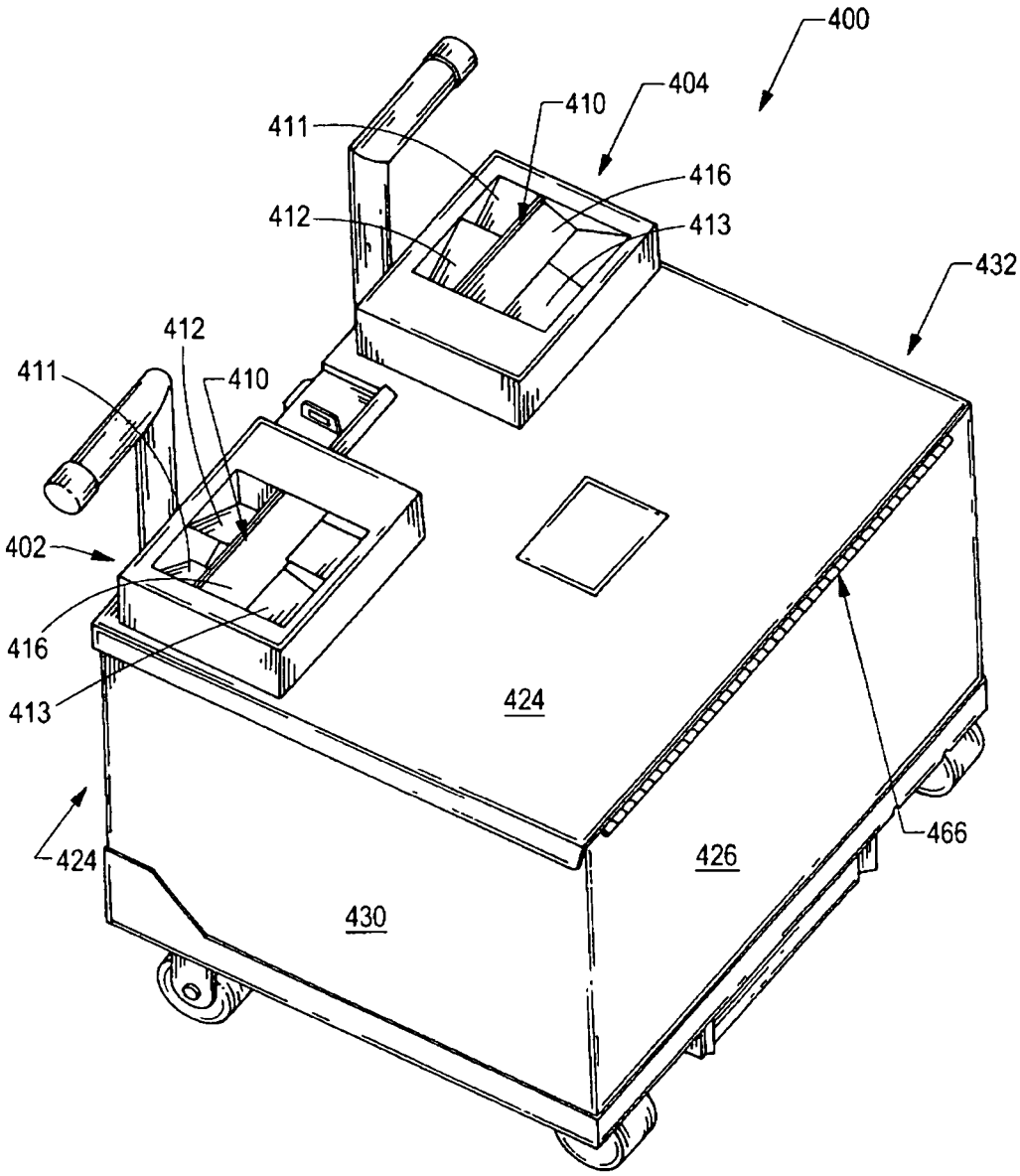
FIG. 17 is an isometric top view of a coin bin having another embodiment of a security grate in accord with the present concepts.
Figure 18:
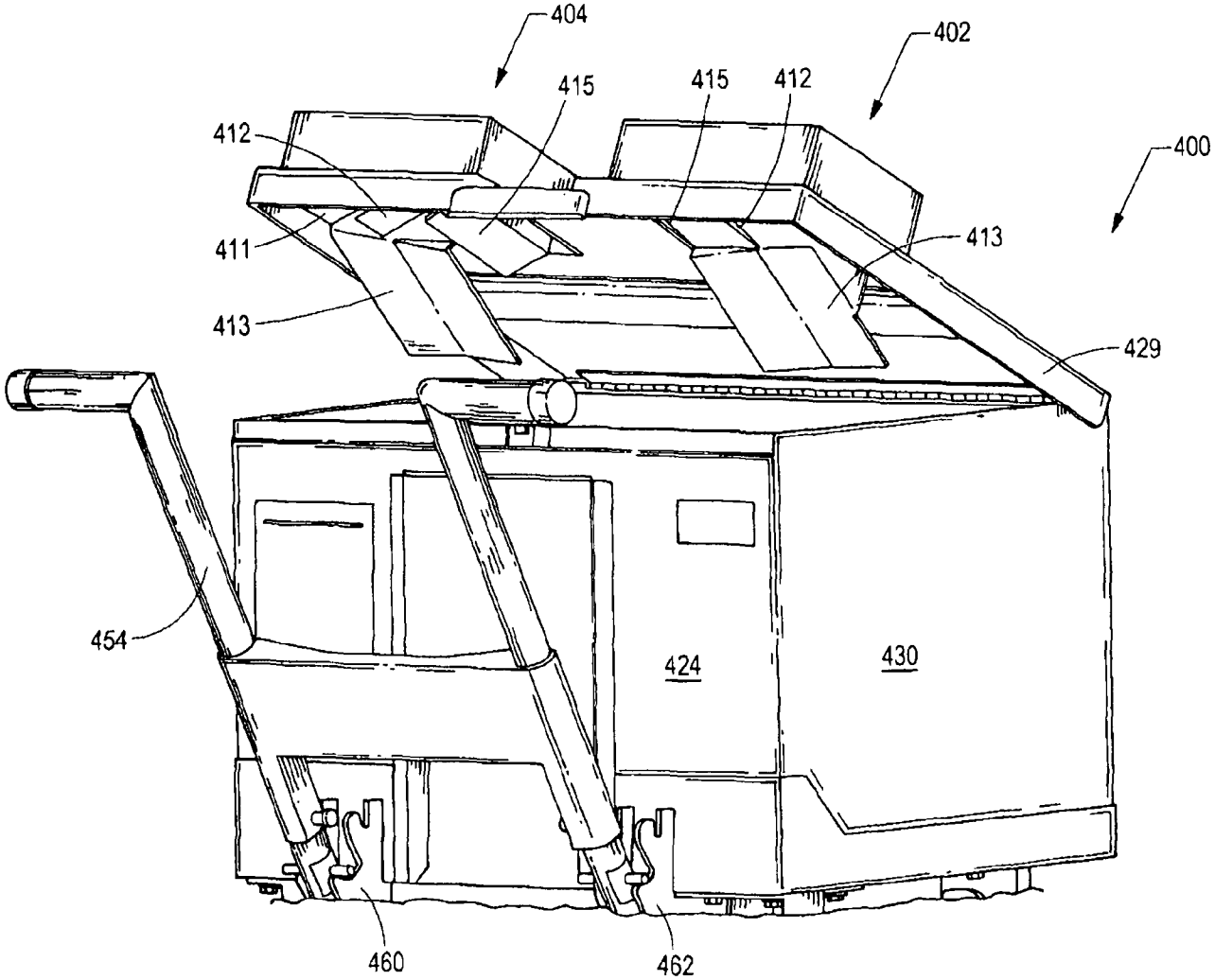
FIG. 18 is another isometric view of a coin bin shown in FIG. 17.

Referring now to FIG. 17, a coin bin 400 is shown according to still another alternative embodiment of the present invention. The coin bin 400 includes a first coin input area 402 and a second coin input area 404 for receiving coins such as, but not limited to, those processed by a coin processing device 14 (FIG. 1). In one aspect, each of the first and second coin input areas 402, 404 include a security grate 410 comprising one or more slats (e.g., 411-416 in FIGS. 17-23) that are angled and/or dimensioned in a manner to limit access to an interior of the coin bin 400. The slats of the security grates 410 are sized, spaced and/or dimensioned to allow the flow of coins from a source, such as coin processing device 14, into the coin bin 100, but to at least inhibit most human digits, hands and arms from accessing coins contained within the coin bin 400. In operation, processed coins output by the source (e.g., coin processing device 14) are directed by directional outputs, funnels, slides, conveyors, or other gravity-feed or mechanical-feed devices to one of the first and second coin input areas 402, 404 where the coins flow through the security grates 410 into the coin bin 400.

Figure 8:
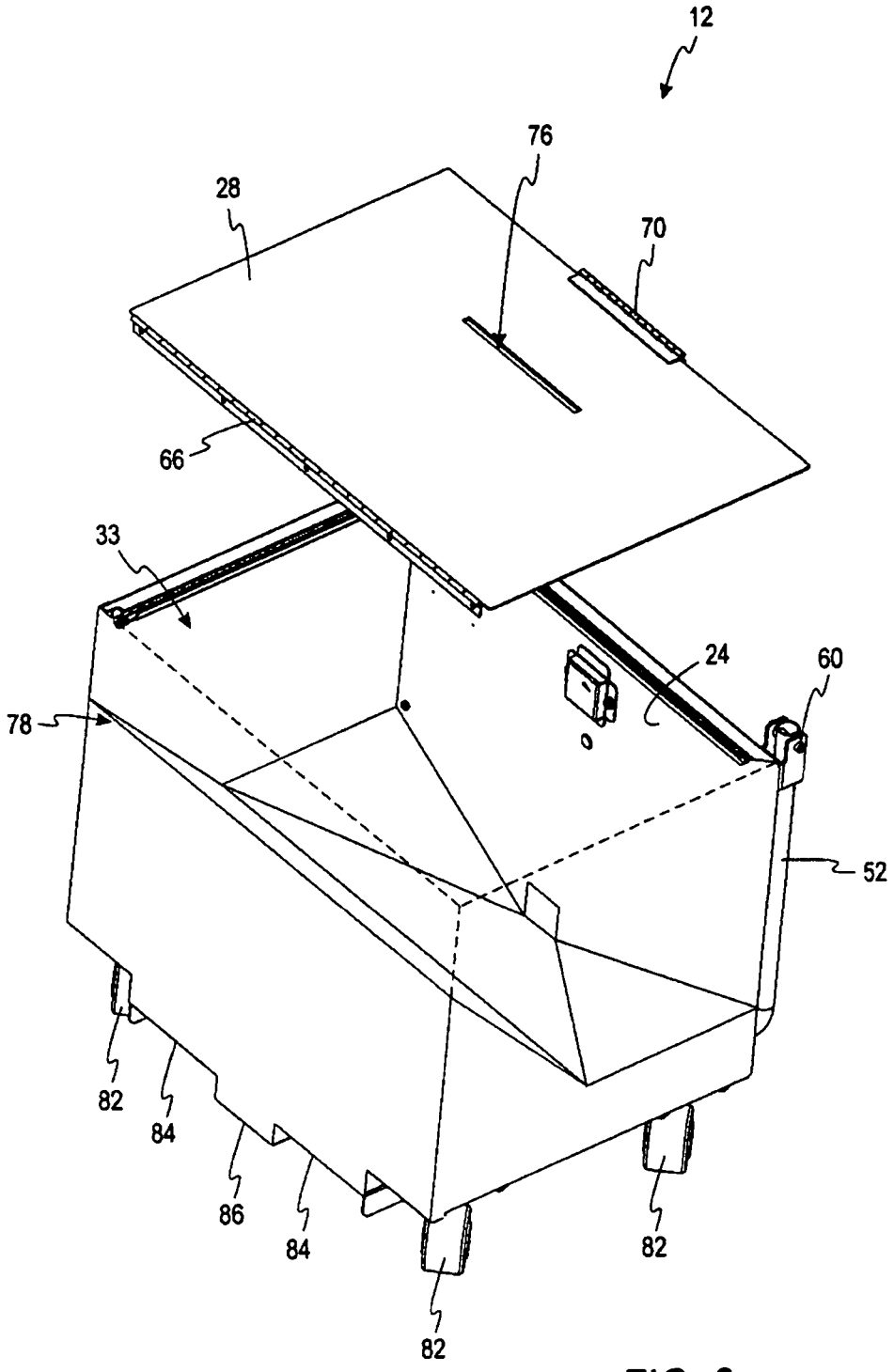
FIG. 8 is an exploded-perspective view of the coin bin of FIG. 1*a* with portions removed to shown the internal structure.

The illustrated coin bin 400 is similar in respects to the exemplary coin bins illustrated in FIGS. 1-12 and generally includes four sides 424, 426, 430, and 432, first and second pivoting brackets 460 and 462 to which a handle 454 may be pivotally mounted, a pivotal lid 429 pivotally attached to the coin bin by a hinge 466 to permit access to an interior of the coin bin, and a locking member 467. The floor of the coin bin 400 may be flat, contoured, or angled, such as shown in FIGS. 8 and 12. A detailed description of these aspects, or other similar aspects, between the various examples is omitted herein for brevity. Instead, attention is directed particularly to the configuration of the first and second coin input areas 402, 404 and security grates 410 in FIGS. 17-23.

Referring to FIG. 17, each coin input area 402, 404 can be seen to be raised above a top surface of the pivotal lid 429 so as to extend or protrude from the top of the coin bin 400. This configuration provides advantages including raising the opening of the first and second coin input areas 402, 404 so as to be disposed closer to an output of the coin source (e.g., coin processing machine 14) and raising the bottoms of the slats 411-416 to further increase the available volume of the coin bin interior.

Slats 411, 412 are similar to those slats shown in FIG. 13. Slats 411, 412 form two pairs of upper slats 421 and lower slats 422, which correspondingly form a first coin path 423 and a second coin path 424 between the slats 411, 412 through which processed coins move under the force of gravity. The upper and lower slats 421, 422 may be integrally formed such that they are formed from the same piece of material or may comprise separate pieces. If provided as separate pieces, the upper and lower slats 421, 422 do not have to be contiguous or touching and may be spaced apart from one another slightly. In one aspect, the slats 411, 412 assume a substantially V-shaped form, similar to that of FIG. 13, and may assume the aforementioned aspects thereof. In one preferred aspect, an angle of between about 50-70°, and more preferably about 60°, is formed between the upper slats 421 and lower slats 422 thereof. As the coins move through the first and second coin paths 423, 424 of the security grate 410, the coins contact the various surfaces of the slats 411, 412. The upper slats 421 direct the coins in a first direction (down and to the right as viewed in FIG. 19) and the lower slats 422 direct the coins in a second direction as the coins move along the coin paths 423, 424 under the influence of gravity. While the illustrated security grate 410 includes two coins paths 423, 424, the security grate may have any practical number of coins paths. Because the slats 411, 412 are subjected to forces applied by the moving coins, the slats constructed of rigid, durable material such as steel, another rigid metal or alloy, or other rigid, highly-durable material (e.g., high molecular weight or ultra-high molecular weight plastics, such as an UHMW Polyethylene). In a preferred aspect, the slats 411, 412 comprise a metal or alloy, such as but not limited to a stainless steel (e.g., a 304 or 404 stainless steel). Slats 411, 412 may optionally be coated with a conventional low-friction, abrasive-resistant coating. The ends of slats 411, 412 may optionally be supported to increase the rigidity of the security grate 410. In another aspect, a dampening material (e.g., vibration or sound dampening) may be advantageously applied to an underside of any of the slats disclosed herein to, for example, minimize the noise generated during coin processing.

The bidirectional coin paths 421, 422 of the security grate 410 effectively prohibit or inhibit a person from accessing the coins within the coin bin 400 through the coin input areas 402, 404. Only those authorized to access the coins in the coin bin 400 may access the coins through appropriately secured access points.

In one aspect, the upper slat 421 of a slat 411 is disposed substantially parallel to and spaced apart from a corresponding upper slat 421 of slat 412 by a distance $d_1$. The lower slats 422 are also disposed an approximately equivalent distance $d_1$ from an adjacent lower slat. The distance $d_1$ is slightly larger than the diameter of the largest coin to be processed. For U.S. currency, the largest-diameter coin typically encountered is a U.S. half-dollar, which has a diameter of about 1.205 inch, which would require the distance $d_1$ to be at least about 1.31 inch. In the horizontal direction, slats 411, 412 are disposed a distance $d_2$ from one another, which may be about 2.11 inches according to one embodiment. The upper slats 421 are disposed at an angle (e.g., $\alpha$ as shown in FIG. 13) relative to the pivotal lid 429 of about 30°. Each of the lower slats 422 are disposed at an angle (e.g., $\beta$ as shown in FIG. 13), which is about 60°, relative to the respective upper slats. The lower slats 422 are downwardly angled from the horizontal at an angle (e.g., $\phi$ as shown in FIG. 13) of about 30°. The upper and lower slats 421, 422 are similarly dimension according to one embodiment of the present invention and have a width of between about 1.5-1.6 inches and a length of each of the upper and lower slats 421, 422 is between about 2.75 and 3.2 inches. The lengths of the slats 411, 412 need not be the same and the slats may have different lengths. For example, slat 411 could be 1.50 inches wide and each of the upper and lower slats 421, 422 could be 2.75 inches long, whereas slat 412 could be 1.50 inches wide and each of the upper and lower slats 421, 422 could be about 3.2 inches long. As noted with the example of FIG. 13, these dimensions may be varied in other alternative embodiments.

Figure 21:
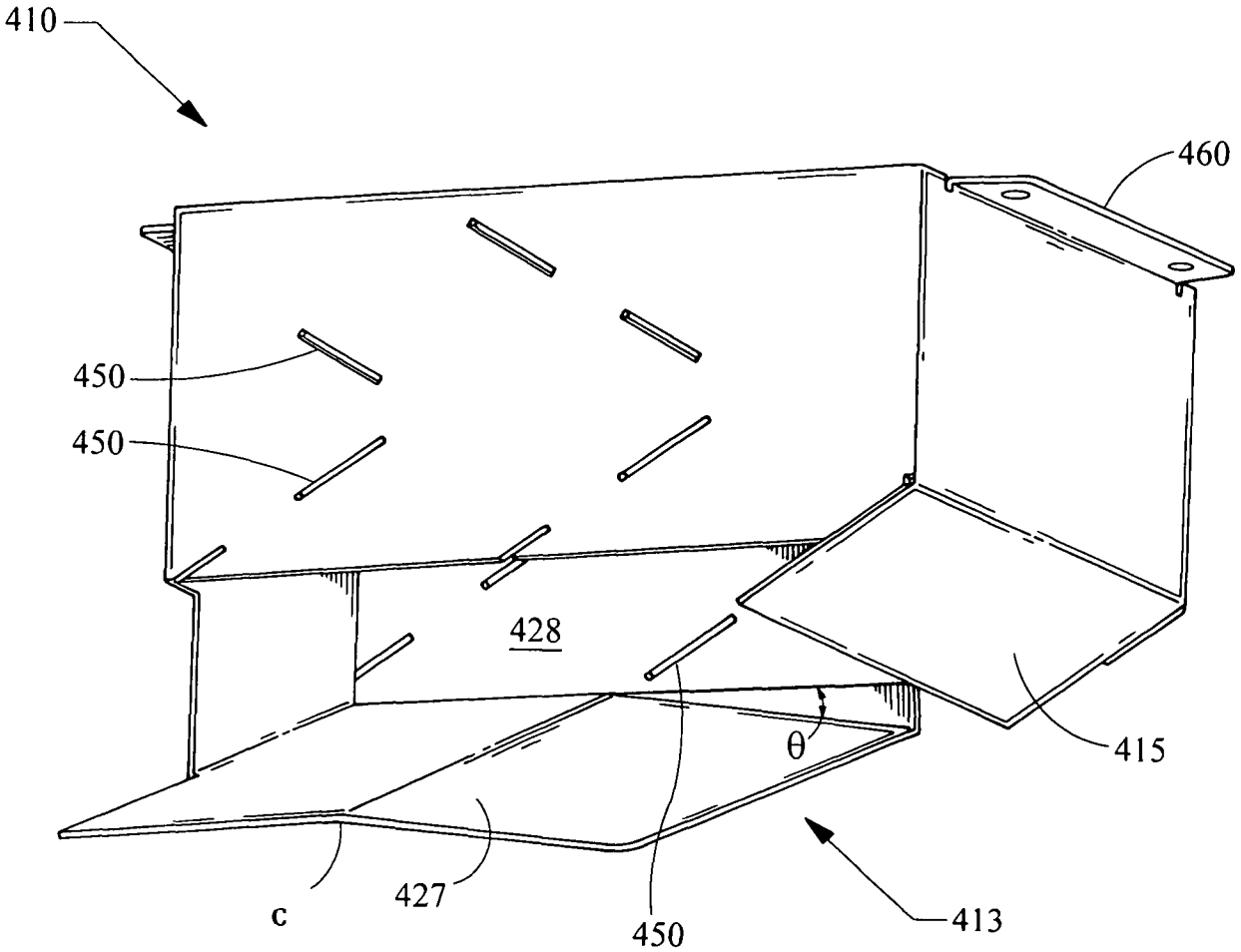
FIG. 21 is another isometric view of a security grate in accord with the present concepts.
Figure 22:
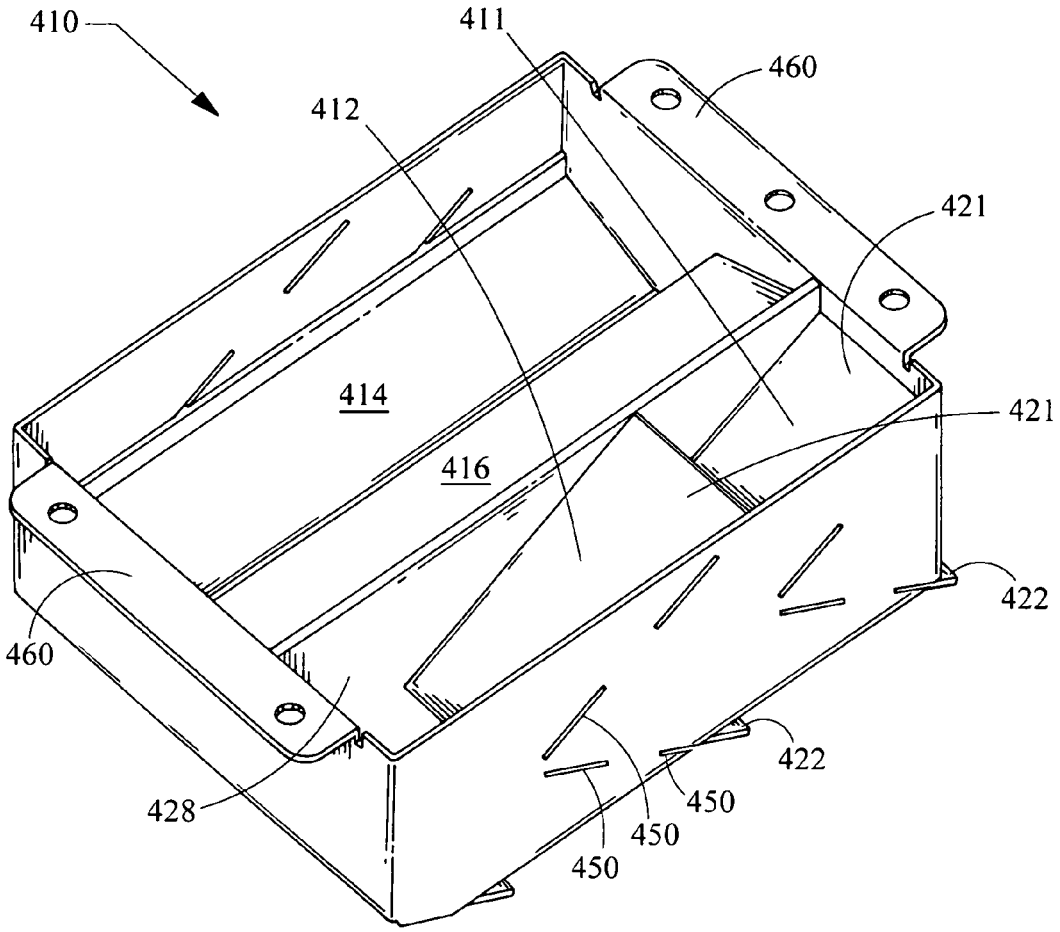
FIG. 22 is an isometric top view of the security grate of FIG. 21.
Figure 23:
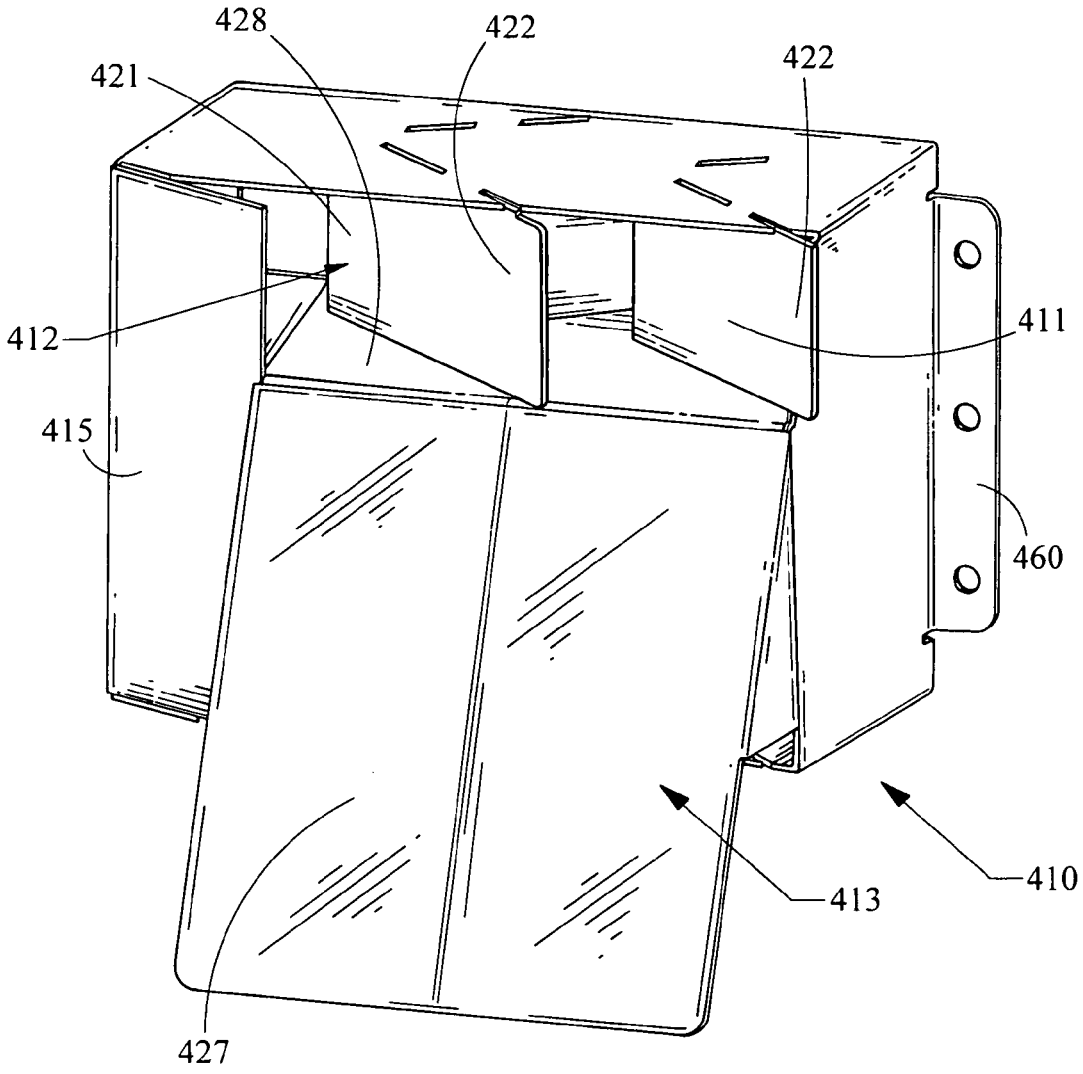
FIG. 23 is an isometric bottom view of the security grate of FIG. 21.

Further to slats 411, 412, the example of FIGS. 17-23 includes additional slats 413-416. Slat 415 is variously shown in FIGS. 17, 19, 21, and 23. Slat 415 is, in one aspect, a lower slat 422 that is attached to, or integrally formed with, a sidewall of security grate 410. Slat 415 is displaced from a corresponding lower slat 422 of slat 412 by distances $d_1$,$d_2$ and is similarly positioned or angled relative to the horizontal. Slat 415 has a width of about 1.68 inches and a depth of about 4.9 inches and is depicted in FIGS. 21 and 23. Slats 414, 416 are disposed above slat 413, as shown in FIG. 22, and form part of a third coin path 425. Slat 416 is, in one aspect, a substantially planar slat having a width of about 1.4 inches and a depth of about 6.25 inches. An upper edge of slat 416 is disposed near a top portion or opening of the coin input area (e.g., 402). The slat is angled downwardly therefrom at a desired angle, such as about 30° from the horizontal. On the opposing side of the security grate 410 is disposed another slat 414. In one aspect, slat 414 also has a width of about 1.4 inches, a depth of about 6.25 inches, and is angled downwardly about 30° from the horizontal. Slat 414 is disposed below slat 416 so as to receive the coins output therefrom. In one aspect, an uppermost portion of slat 414 is disposed about 1.37 inches from the uppermost portion of slat 416. As illustrated, slats 414, 416 do not cross over one another, but may be optionally dimensioned to cross one another. The output of slat 414 is directed toward an upper base portion of slat 413, which angles back in substantially the same direction as slat 416. Thus, the third coin path 425 contains two reversals of direction.

Slat 413 includes an elongated portion 427 and a base portion 428. The elongated portion 427 extends outwardly and downwardly from the security grate 410. The base portion 428 is attached to the security grate 410 using conventional mechanical attachment devices including but not limited to tongue or slot and groove or mechanical fasteners. Alternatively, the base portion of slat 413 may be integrally formed as a part of the security grate by processes including, but not limited to, stamping. In the aspect illustrated in FIGS. 17-18, the elongated portion 427 of slat is 413 extends toward a back portion of the coin bin 400. In this orientation, the elongated portion 427 of slat 413 directs the coins output thereby away from the vicinity of the coins output from slats 411, 412 and away from the vicinity of some of the coins output from a portion of slat 415 adjacent slats 411, 412. In the illustrated orientation, coins output from slat 413 are directed toward a back of the coin bin 400 by the elongated portion 427 of slat 413. The inventors have found that, further to the aforementioned security benefits, this arrangement of slat 413 increases the utilization of the coin bin space by better distributed the coins therein and enables a given volume of the coin bin to be used more effectively. In one aspect, the elongated portion 427 of slat 413 is angled downwardly at an angle between about 18-24° from the horizontal and, still more preferably, about 20° from the horizontal. The elongated portion 427 of slat 413 may be substantially planar. In the illustrated aspect, the elongated portion 427 of slat 413 shows a preferred aspect wherein at least one surface lateral to a centerline C of the elongated portion 427 is angled slightly downwardly by an angle $\theta$ relative thereto to facilitate discharge of coins therefrom. This angle $\theta$ may range between about 0° and 10-15°, but is preferably about 8-10°. In alternate configurations, both lateral side portions of the elongated portion 427 could be angled downwardly relative to the centerline C and/or and end of the elongated portion 427 could also be angled downwardly relative to the rest of the elongated portion 427.

The multi-directional coin paths, including but not limited to the illustrated first, second, and third coin paths 423, 424, 425, of the security grate 400 effectively prohibit or inhibit a person from accessing the coins within the coin bin 400 through the coin input areas 402, 404 of the storage bin. Put another way, the non-linear nature of the coin paths 423, 424, 425 prohibit unauthorized access to the coin bin 400. This multi-directionality could be accomplished using a combination of slats having any size and/or configuration. The security grate 410 may also advantageously utilize curved or curvilinear slats to the same end.

Figure 19:
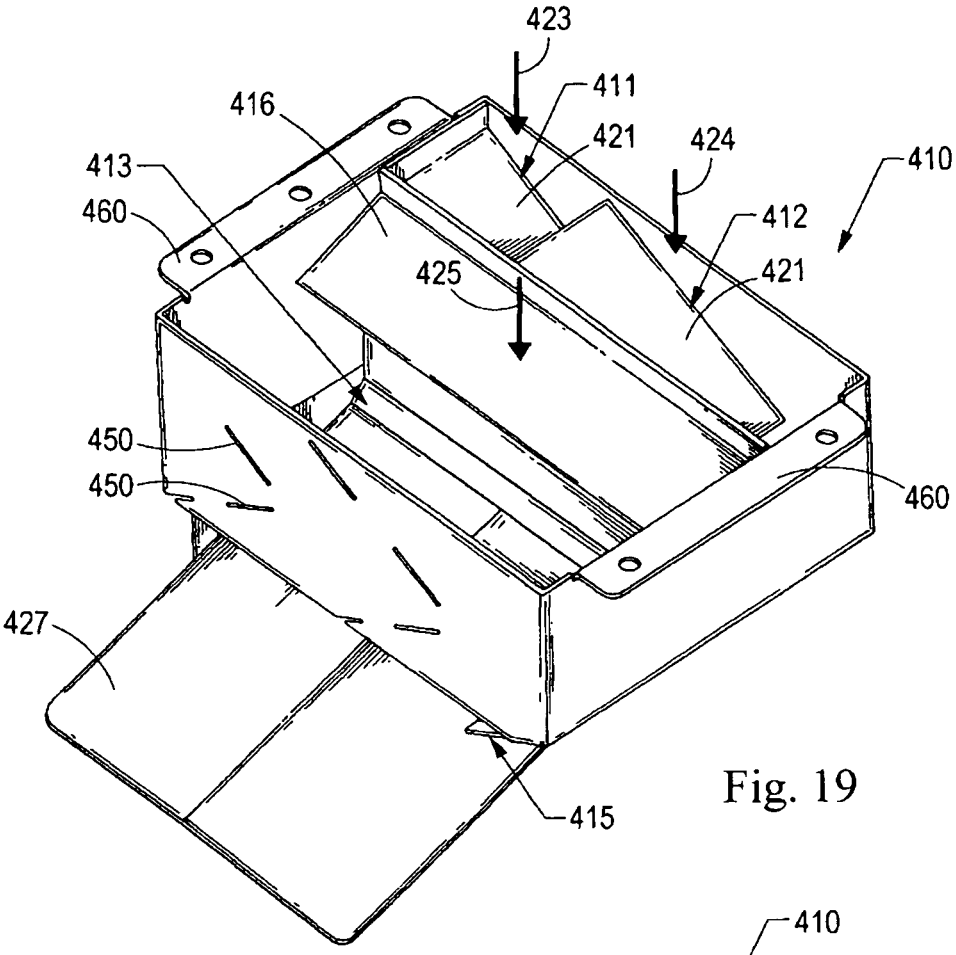
FIG. 19 is an isometric view of a security grate in accord with the present concepts.
Figure 20:
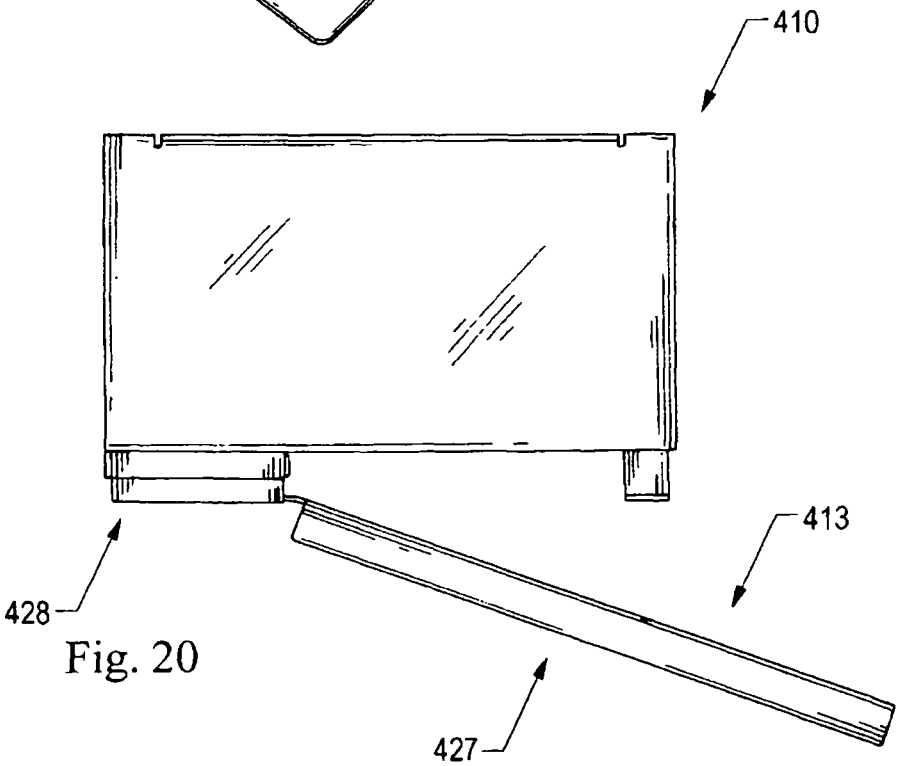
FIG. 20 is a side view of the security grate of FIG. 19.

FIGS. 19 and 21-23 show a plurality of slots or apertures 450 within the side portions of security grate 410. These apertures 450 are advantageously provided as attachment and/or securement devices for slats 411, 412, 414, 415, and 416, which are provided with outwardly extending tabs or protrusions corresponding substantially in size and shape to the size and shape of the apertures. The slat tabs fit into the corresponding apertures 450 and hold the slats in place at multiple points to maintain the position of the slats as the slats are contacting by the moving coins. Flanges 460 are provided to facilitate mounting of the security grate 410 within the respective coin receiving area 402, 404 mounting structure. As shown in FIG. 19, the apertures 450 are provided on opposing sides of the security grate 410 in a mirror image arrangement to enable the same security grate to be used for two different orientations (e.g., mirror image) of slats. Apertures 450 may be provided on one of, or all of, the security grate 410 side walls to permit the security grate to assume different configurations. The base portion 428 of slat 413 is also provided with apertures 450 to facilitate securement of an adjacent side of slats 411, 412 thereto. Slat 413 is, in turn, held in part by its attachment to slats 411, 412. Slat 413 is also retained in place by the positioning of slat 415, as a lateral portion of the base portion 428 of slat 413 is chamfered or formed at an angle corresponding to that of slat 415 and rests thereupon. The sides of the base portion 428 of slat 413 may also be provided with outwardly extending tabs or protrusions corresponding substantially in size and shape to the size and shape of apertures (not shown) provided in respective areas of the security grate 410.

As is apparent from the foregoing, the security grate 410 provides a physical deterrent, as well as a visual deterrent, which discourages and prevents unauthorized entry into or tampering with the contents of the coin bin 400. Due to the aforementioned slats 411-416, and any variants thereof, providing multi-directional coin paths wherein coins are caused to move along a convoluted pathway, a person cannot view or access the coins contained within the coin bin 400 through the security grate 410. Thus, the security grates 410 provide a real barrier, as well as a psychological barrier, to prevent an unauthorized persons from accessing coins contained within the coin bin 400.

Other security features may be implemented in combination with the above aspects. For example, a security screen may cover the aforementioned coin input areas whole providing openings sized large enough to allow coins to flow through the screens (e.g., openings dimensioned slightly larger than the diameter of the largest coin to be processed), but small enough to prevent a human hand from reaching through a screen opening to access coins contained within the coin bin. The screen is constructed out of a strong material such as metal, for example, and sized such that is difficult to cut or otherwise damage the screen in an unauthorized attempt to access the coins contained within the coin bin. Other types of security features to prevent unauthorized access into the coin bin may also be implemented in alternative embodiments of the present invention so long as the added security features do not unduly interfere with the movement of coins through the security feature and into the coin bin.

The inventors have found that the aforementioned security features not only prevent unauthorized access into the coin bins (e.g., reaching through the security feature), but also facilitate the free flow of coins through the security feature and into the coin bin. Further, the security slats have been found to effectively increase the coin capacity of the coin bins by helping to create a uniform coin distribution and by helping to prevent jamming and overflow of coins. In one aspect, the slats were able to increase the capacity of the coin bins significantly for a predetermined mix of coins (e.g., the Cummins mix). This increase in capacity permits longer periods of coin bin utilization for a given coin bin geometry and, depending upon the application and location, fewer pickups by currency transport services, with an attendant reduction in operating costs associated therewith.

While the invention is susceptible to various modifications and alternative forms, specific embodiments are shown by way of example in the drawings and herein described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

What is claimed is:

1. A security feature for a coin bin comprising:

a plurality of slats extending downwardly from a coin input area of the coin bin and toward an interior volume of an associated coin bin;

at least one of the plurality of slats having a base portion extending downwardly from the coin input area in a first direction and an elongated portion extending downwardly from the base portion in a second direction different than the first direction, wherein a length of the elongated portion is greater than a length of the base portion.

2. A security feature for a coin bin according to claim 1, wherein the elongated portion of the slat extends downwardly at an angle with respect to the horizontal between about 0-24°.

3. A security feature for a coin bin according to claim 1, wherein the elongated portion of the slat extends downwardly at an angle with respect to the horizontal between about 18-24°.

4. A security feature for a coin bin according to claim 1, wherein a lateral portion of the elongated portion of the slat extends downwardly at an angle with respect to the elongated portion between about 8-10°.

5. A security feature for a coin bin according to claim 1, wherein lateral portions of the elongated portion of the slat extend downwardly at an angle with respect to the elongated portion between about 8-10°.

6. A security feature for a coin bin according to claim 1, wherein an end portion of the elongated portion of the slat extends downwardly at an angle with respect to the elongated portion between about 0-10°.

7. A security feature for a coin bin according to claim 2, wherein a lateral portion of the elongated portion of the slat extends downwardly at an angle with respect to the elongated portion between about 8-10°.

8. A security feature for a coin bin according to claim 2, wherein lateral portions of the elongated portion of the slat extend downwardly at an angle with respect to the elongated portion between about 8-10°.

9. A security feature for a coin bin according to claim 2, wherein an end portion of the elongated portion of the slat extends downwardly at an angle with respect to the elongated portion between about 0-10°.

10. A security feature for a coin bin according to claim 3, wherein a lateral portion of the elongated portion of the slat extends downwardly at an angle with respect to the elongated portion between about 8-10°.

11. A security feature for a coin bin according to claim 3, wherein lateral portions of the elongated portion of the slat extend downwardly at an angle with respect to the elongated portion between about 8-10°.

12. A security feature for a coin bin according to claim 3, wherein an end portion of the elongated portion of the slat extends downwardly at an angle with respect to the elongated portion between about 0-10°.

13. A coin bin for holding coins from a coin processing device, comprising:

a bottom member, a top member, and a plurality of side walls collectively defining an interior volume adapted to hold a plurality of coins;

a coin input area disposed in the top member for receiving coins from the coin processing device;

a security grate mounted on the top member, the security grate comprising at least one slat having a base portion extending downwardly from the coin input area in a first direction and an elongated portion extending downwardly from the base portion in a second direction different than the first direction and a bracket configured to hold the base portion and the elongated portion of the slat in fixed positions; and wherein a length of the elongated portion is greater than a length of the base portion.

14. A coin processing machine comprising:

a coin bin having a plurality of walls defining an interior volume for holding coins, and a coin input area at a top portion of the coin bin configured to receive coins from the coin processing device;

a pivotal lid attached to the top portion of the coin bin comprising an aperture corresponding to the coin input area, wherein the pivotal lid is configured to pivot from a closed position to an open position allowing access to coins contained within the interior volume; and a slat configured to convey the coins received from the coin input area into the coin bin interior volume, the slat having an upper base portion extending downwardly from the coin input area in a first direction and an elongated lower portion extending downwardly from the upper base portion in a second direction different than the first direction; and wherein a length of the elongated lower portion is greater than a length of the upper base portion.

15. A coin processing machine comprising:

a coin bin having a plurality of walls defining an interior volume for holding coins;

a coin input area defined in a top wall of the coin bin configured to receive coins from a coin processing device; and a coin path from the coin input area to the interior volume of the coin bin defined by a slat with an upper base portion extending downwardly from the coin input area in a first direction and a lower portion extending downwardly from the upper base portion in a second direction different than the first direction and extending laterally beyond the coin input area in a cantilevered configuration to direct coins under the force of gravity to a side of the interior volume of the coin bin opposite the coin input area.

16. A coin processing machine comprising:

a coin bin having a plurality of walls defining an interior volume for holding coins; and a coin input area at a top portion of the coin bin configured to receive coins from a coin processing device, the coin input area comprising a security grate defining a coin path from the coin input area to the interior volume of the coin bin, wherein the security grate comprises a first slat with a first upper base portion extending downwardly from the coin input area in a first direction and a first elongated lower portion extending downwardly from the first upper base portion in a second direction different than the first direction and a second slat with a second upper base portion extending downwardly from the coin input area in the first direction and a second lower portion extending downwardly from the second upper base portion in the second direction, wherein the distance between the first slat and the second slat is approximately the diameter of the largest coin to be processed, and wherein a length of the first elongated lower portion is greater than a length of the first upper base portion and a length of the second elongated lower portion is greater than a length of the second upper base portion.

17. A security feature for a coin bin comprising:

a plurality of slats extending downwardly from a coin input area of the coin bin and toward an interior volume of the coin bin;

at least some of the slats being oriented in a first direction; and at least one of the plurality of slats being oriented in a second direction different than the first direction, the at least one of the plurality of slats having a base portion extending downwardly from the coin input area and an elongated portion depending therefrom, wherein a length of the elongated portion is greater than a length of the base portion.

18. The security feature of claim 17, wherein the first direction is substantially perpendicular to the second direction.

* * * * *